US011369205B2

(12) United States Patent
Reed, II et al.

(10) Patent No.: US 11,369,205 B2
(45) Date of Patent: Jun. 28, 2022

(54) COLLAPSIBLE, PORTABLE CHAIR WITH INTEGRATED TEMPERATURE CONTROL

(71) Applicants: Ronald Michael Reed, II, Lakeway, TX (US); Andrew F. Fireman, North Bethesda, MD (US)

(72) Inventors: Ronald Michael Reed, II, Lakeway, TX (US); Andrew F. Fireman, North Bethesda, MD (US)

( * ) Notice: Subject to any disclaimer, the term of this patent is extended or adjusted under 35 U.S.C. 154(b) by 0 days.

(21) Appl. No.: 16/746,815

(22) Filed: Jan. 18, 2020

(65) Prior Publication Data

US 2021/0059418 A1 Mar. 4, 2021

Related U.S. Application Data

(60) Provisional application No. 62/890,049, filed on Aug. 21, 2019.

(51) Int. Cl.

| | |
|---|---|
| ***A47C 7/74*** | (2006.01) |
| ***A47C 1/16*** | (2006.01) |
| ***A47C 7/62*** | (2006.01) |
| ***A47C 4/28*** | (2006.01) |

(52) U.S. Cl.

CPC ..... *A47C 7/748* (2013.01); *A47C 1/16* (2013.01); *A47C 4/286* (2013.01); *A47C 7/624* (2018.08); *A47C 7/744* (2013.01)

(58) Field of Classification Search

CPC .. A47C 7/48; A47C 7/624; A47C 1/16; A47C 4/286; A47C 7/744

See application file for complete search history.

(56) References Cited

U.S. PATENT DOCUMENTS 7,866,743 B1 * 1/2011 Russell ..... A47C 7/74 297/180.1 X
9,101,222 B2 * 8/2015 Minkoff ..... A47C 4/286

FOREIGN PATENT DOCUMENTS

WO WO-2019000013 A1 * 1/2019 ..... A47C 7/744

* cited by examiner

*Primary Examiner* — Anthony D Barfield

(57) ABSTRACT

A portable collapsible chair may include a frame that may be collapsed to enable a user to carry or store the chair and that may be expanded to form a chair on which the user may sit. The chair may further include a backrest coupled to the frame, a seat coupled to the frame, and one or more heat exchangers. The chair may also include a control circuit coupled to the one or more heat exchangers. The control circuit may provide a first signal to at least some of the one or more heat exchangers to warm the chair in a warming mode or may provide a second signal to at least some of the one or more heat exchangers to cool the chair in a cooling mode.

20 Claims, 12 Drawing Sheets

COLLAPSIBLE, PORTABLE CHAIR WITH INTEGRATED TEMPERATURE CONTROL

CROSS-REFERENCE TO RELATED APPLICATION(S)

The present application is a non-provisional of and claims priority to U.S. Provisional Application No. 62/890,049 filed on Aug. 21, 2019 and entitled "Collapsible, Portable Chair with Integrated Temperature Control", which is incorporated herein by reference in its entirety.

FIELD

The present disclosure is generally related to collapsible, portable chairs, and more particularly, to collapsible, portable chairs with integrated temperature control.

BACKGROUND

Portable, collapsible chairs are often used by spectators or other attendees at various events. Such chairs may also be used by people at the beach, camping, tailgating, outside in the backyard, and so on. In some implementations, such chairs may include stadium seats that can be releasably coupled to a bleacher or to another seat or chair. Such portable chairs are usually made from lightweight materials, can fit into a trunk, back seat, truck bed, or other area of a vehicle, and can easily be carried by an individual. In some instances, such chairs may include a cinch-bag or drawstring bag (sometimes with a shoulder strap) sized to hold the chair to secure and easily carry the chair.

SUMMARY

Embodiments of a portable, collapsible chair are described below that may include integrated thermal regulation to provide enhanced comfort for a user. The chair may be unfolded and placed on the ground (in the case of a chair with legs) or may be unfolded and placed on a bench, bleacher, or stadium chair (in the case of a bleacher seat). The chair may include one or more thermoelectric elements to warm portions of the chair in a warming mode and to cool portions of the chair in a cooling mode.

In some implementations, the chair may include a circuit coupled to the one or more thermoelectric elements and to one or more sensors. The circuit may include a controller configured to determine an ambient temperature based on signals from the one or more sensors, to automatically select one of a warming mode or a cooling mode, and to automatically control the one or more thermoelectric modules based on the selected mode. In an example, the controller may be configured to provide one or more signals to cause the one or more thermoelectric modules to achieve and maintain a selected temperature differential relative to the ambient temperature. In some implementations, the temperature differential may be selected by a user via a control interface, which may be provided via an application executing on a computing device (such as a smartphone, a tablet computing device, or another computing device) or via a control device connected to the circuit (such as a control panel, a fob, or another device that provides a user-accessible interface). In other implementations, the temperature differential may be pre-programmed. Other implementations are also possible.

In some implementations, the chair may include a plurality of thermoelectric elements, which may be distributed in the back portion of the chair, the seat portion of the chair, the armrests, or any combination thereof to provide cooling or heating, depending on the selected mode. In some implementations, each of the heat exchangers may include one or more Peltier devices, which may provide cooling in response to a first signal and warming in response to a second signal.

In other implementations, the chair may include a fluid circulation system configured to circulate a fluid through one or more heat exchangers embedded in the chair. The fluid temperature may be regulated to provide warming or cooling, according to a selected temperature. The fluid circulation system may include tubing and one or more pumps to circulate fluid from a container through the heat exchangers and back to the container. The heat exchangers may draw heat away from the chair when the circulating fluid is cooler than the chair and may deliver heat to the chair when the circulating fluid is warmer than the chair. Other implementations are also possible.

In some implementations, the material of the chair may include perforated fabric or other thermo-conducting fabric configured to facilitate heat exchange. The fabric used to form the seat, backrest, and optional armrests (or to cover the padded seat, backrest, and optional armrests) may be selected for comfort, moisture wicking characteristics, heat transfer characteristics, aesthetics, other characteristics, or any combination thereof.

In some embodiments, a chair comprises a collapsible frame including a seat portion and a backrest portion. The chair further comprises one or more thermoelectric modules coupled to at least one of the seat portion or the backrest portion and a control circuit coupled to the one or more thermoelectric modules. In a warming mode, the control circuit may provide at least one first signal to the one or more thermoelectric modules to warm the at least one of the seat portion or the backrest portion. In a cooling mode, the control circuit may provide at least one second signal to the one or more thermoelectric modules to cool the at least one of the seat portion or the backrest portion. The amplitude of the second signal may differ from the amplitude of the first signal to achieve a similar temperature differential relative to the ambient temperature.

In some embodiments, a chair comprises a frame including one or more pivot elements to facilitate collapsing of the frame to enable a user to carry the frame in a first state and to facilitate expansion of the frame to form a chair in a second state. The chair comprises a backrest coupled to the frame, a seat coupled to the frame, one or more heat exchangers coupled to one or more of the backrest and the seat, and a control circuit coupled to the one or more heat exchangers. The control circuit may be configured to provide a one or more first signals to the one or more heat exchangers to produce a warming effect in a warming mode and to provide one or more second signals to the one or more heat exchangers to produce a cooling effect in a cooling mode. The phrase "warming effect" may refer to the capability of the heat exchangers to warm to a temperature that is greater than ambient by a predetermined amount, and the term "cooling effect" may refer to the capability of the heat exchangers to cool to a temperature than is less than ambient by a predetermined amount.

In other embodiments, a chair comprises a collapsible frame including a seat portion and a backrest portion, a first armrest and a second armrest coupled to the frame, one or more heat exchangers coupled to one or more of the backrest, the seat, the first armrest, or the second armrest, and a control circuit coupled to the one or more heat exchangers.

In a warming mode, the control circuit may provide at least one first signal to the one or more thermoelectric modules to provide a warming effect. In a cooling mode, the control circuit may provide at least one second signal to the one or more thermoelectric modules to provide a cooling effect. In the warming mode, the at least one first signal comprises a first signal and one or more second signal. The first signal may have a first amplitude to provide a first temperature difference relative to an ambient temperature, and the one or more second signals may have one or more second amplitudes to provide one or more second temperature differences relative to the ambient temperature. In the cooling mode, the at least one second signal comprises a third signal and one or more fourth signals. The third signal may have a third amplitude to provide a third temperature difference relative to the ambient temperature, and the one or more fourth signals may have one or more fourth amplitudes to provide one or more fourth temperature differences relative to the ambient temperature.

In some implementations, to prevent the user from becoming desensitized to the warming or cooling effect, the control circuit may provide a time-varying signal, which may cause the heat exchangers to vary in temperature. In one implementation, the control circuit may provide one or more time-varying signals to one or more thermoelectric elements so that the thermoelectric elements do not reach a constant temperature, but rather fluctuate about a pre-determined temperature differential (e.g., 10 degrees plus or minus 2 degrees). By varying the signal to vary the temperature differential, the user does not become desensitized to the cooling or warming effect. In another implementation, the control circuit may provide one or more time varying signals to one or more pumps so that the heat exchangers do not reach a constant temperature. In some examples, the pump may reverse the fluid flow periodically (or aperiodically) to cause the heat exchangers to fluctuate in temperature over time. Other implementations are also possible.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
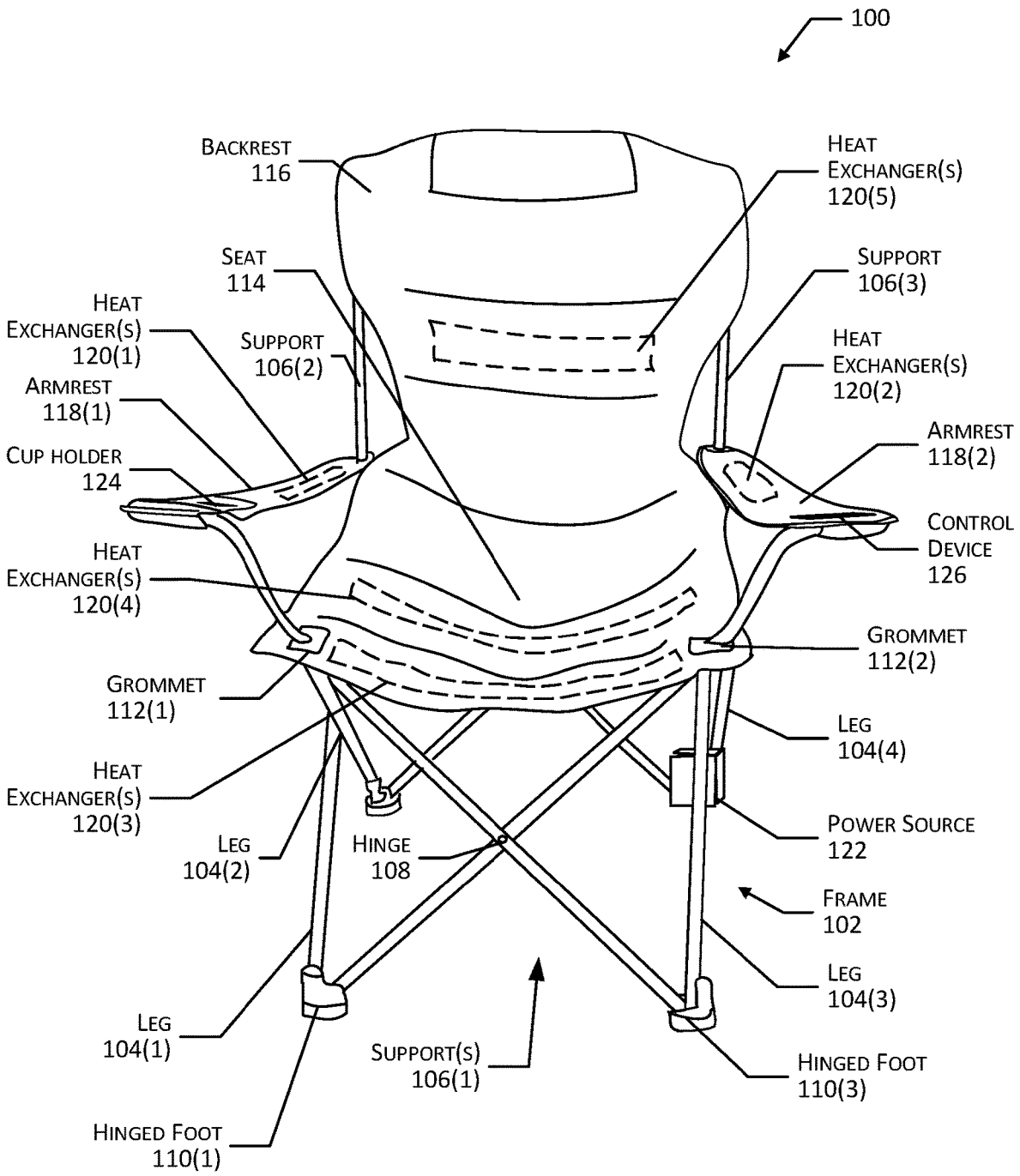
FIG. 1 depicts a perspective view of a portable, collapsible chair with integrated thermal management using electrical devices, in accordance with certain embodiments of the present disclosure.

While implementations are described herein by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF ILLUSTRATIVE EMBODIMENTS

Portable collapsible chairs are often carried by spectators of sporting events, such as youth sporting events, or by participants in other outdoor activities, such as camping, tailgating, sitting on the beach, and the like. Such chairs are typically light weight and can be readily collapsed or folded for easy transportation and storage. While such chairs are convenient and often far more comfortable than sitting on a bench or on the ground or standing, human comfort involves multiple variables, including temperature.

In some instances, the temperature of the chair may influence the user's comfort. In cold weather, a chair that is warmer than the ambient temperature may be deemed more comfortable than a chair matching the ambient temperature.

Similarly, in warm weather, a chair that is cooler than the ambient temperature may be deemed more comfortable than a chair matching or exceeding the ambient temperature. Embodiments of a comfortable, cozy, portable chair are disclosed that include integrated thermal regulation to provide enhanced comfort for a user. The chair may be unfolded and placed on the ground (in the case of a chair with legs) or may be unfolded and placed on a bench, bleacher, or other seat (in the case of a bleacher seat). The chair may include one or more heat exchangers configured to warm portions of the chair in a warming mode and to cool portions of the chair in a cooling mode. In some implementations, the heat exchangers may include thermoelectric elements or modules that warm or cool in response to electrical signals. In other implementations, the heat exchangers may include conduits or tubes to circulate a fluid to warm or cool the chair.

In some implementations, the chair may include a circuit coupled to the one or more thermoelectric elements and including one or more sensors. The circuit may include a controller configured to determine an ambient temperature based on signals from the one or more sensors, to automatically select one of a warming mode or a cooling mode, and to automatically control the one or more thermoelectric modules based on the selected mode. In an example, the controller may be configured to provide one or more signals to cause the one or more thermoelectric modules to achieve and maintain a selected temperature differential relative to the ambient temperature. In some implementations, the temperature differential may be selected by a user via a control interface, which may be provided via an application executing on a computing device (such as a smartphone, a tablet computing device, or another computing device) or via a control panel connected to the circuit (such as a control device, a fob, or another device that provides a user-accessible interface). In other implementations, the temperature differential may be pre-programmed. Other implementations are also possible.

In some implementations, the chair may include a plurality of thermoelectric elements, which may be distributed in the back portion of the chair, the seat portion of the chair, the armrests, or any combination thereof to provide cooling or heating, depending on the selected mode. Each of the heat exchangers may include one or more Peltier devices, which may provide cooling in response to a first signal and warming in response to a second signal.

In an example, a difference between the chair temperature and the body temperature of the user or the chair temperature and the ambient temperature may determine whether the chair provides a cooling effect or a warming effect from the perspective of the user. Moreover, certain areas of the user's body may be more sensitive to warming or cooling than other areas, and the thermoelectric elements may be positioned to take advantage of such sensitivity. In some implementations, the cooling or warming signal may be time-varying so that the user does not become desensitized to the affect.

Embodiments of portable, collapsible chairs are described below that include integrated thermal management. The chair may include one or more heat exchangers positioned in different areas of the chair to provide a thermal sensation for the user. As used herein, the term "heat exchanger" is used to describe a mechanism for delivering a thermal effect to the surface of the chair and thus indirectly to the user who is sitting in the chair. The heat exchanger may include multiple components, such as fluid-circulating tubes for circulating a thermal fluid within the chair cover, thermoelectric devices (such as Peltier devices), fans, thermal fabrics, other components, or any combination thereof. The heat exchangers may be positioned in the seat, the backrest, the armrests, or any combination thereof.

In some implementations, the heat exchangers may include Peltier devices that provide a cooling effect in response to a first signal (such as a current flowing in a first direction) and that provide a warming effect in response to a second signal (such as a current flowing in a second direction opposite to the first direction). In other implementations, the heat exchangers may include a conduit or tube through which a thermal fluid may be circulated to deliver the thermal effect. The chair may include or may be coupled to a control device that can be accessed by a user to choose the thermal effect desired and optionally to increase or decrease the thermal effect.

In some implementations, the armrest of the chair may include a cupholder, a phone holder or recess, another opening, or any combination thereof. In some examples, the armrest may include a first heat exchanger to deliver a thermal effect to the user's forearm, a second heat exchanger to deliver a second thermal effect to the cupholder, and a third heat exchanger to deliver a third thermal effect to the phone holder or recess. The phone holder or recess may also include a universal serial bus (USB) connector or port to provide a recharging functionality for a connected phone or computing device. Other implementations are also possible.

In the following discussion, the heat exchangers are depicted as embedded within or coupled to the fabric of the chair. However, it should be appreciated that the heat exchanger could be implemented as a separate apparatus, such as a cover or blanket, that can be draped over a chair, such as a chair cover. One possible implementation of a chair with integrated thermal management is described below with respect to FIG. 1.

FIG. 1 depicts a perspective view of a system including a portable, collapsible chair 100 with integrated thermal management using electrical devices, in accordance with certain embodiments of the present disclosure. The chair may include a frame 102 including legs 104 and supports 106. The supports 106 may be coupled to one another by a pivot or hinge 108. One or more of the supports 106 may be coupled to a leg 104 at a hinged foot 110. The legs 104 and the supports 106 may be described as frame members that are pivotally connected to each other by pivots or hinges 108, each of which may define a pivot axis. The legs 104 and the supports 106 may pivot about one or more pivot axes such that at least some of the plurality of frame members (legs 104, supports 106, or both) are parallel to one another in a collapsed configuration (a storage state, a transportation state, or a first state) and are oriented in a crossed manner when chair 100 is in a first configuration (an operational state or second state). The frame 102 may be folded or collapsed into a first state that enables the user to carry the chair 100 or may be expanded into a second state that forms the chair 100. In the second (expanded) state, the legs 104 of the chair 100 may be placed on the ground, and the frame 102 may be stable, providing a stable chair on which a user may sit.

In some implementations, the frame 102 may include arm supports that may extend through grommets 112 in a seat 114 of the chair 100. The chair 100 may include a fabric cover coupled to the frame 102 and configured to form a backrest 116, the seat 114, and armrests 118.

The chair 100 may include multiple heat exchangers 120. In some implementations, the chair, the armrest 118(1) may include a first heat exchanger 120(1). The armrest 118(2) may include a second heat exchanger 120(2). The seat 114 may include heat exchangers 120(3) and 120(4). The backrest 116 may include heat exchangers 120(5). In some implementations, the armrest 118(1) may include a cupholder 124. The cupholder 124 may also include a heat exchanger 120. In some implementations, the armrest 118(2) may also include a cupholder 124. Further, one or both armrests 118 may include an opening or a holder sized to receive car keys, a phone, a wallet, other items, or any combination thereof. In one possible example, the opening to receive the phone may include a recharging feature, such as a Universal Serial Bus (USB) connector or port to receive a recharger cable to provide a recharge signal to the smartphone or other computing device. The USB port may be coupled to a power source 122 to receive a power supply. Other implementations are also possible.

The chair 100 may include a power source 122 to supply power to the heat exchangers 120. In some implementations, the power source 122 may be a Universal Serial Bus (USB) recharger device, such as those commonly used to recharge a smartphone or computing device through a USB connection. The electrical leads of the chair 100 may be coupled to a USB connector configured to fit the USB port of the power source 122. It should be appreciated that the USB standard defines current and voltage limits and overvoltage and fault regulations, which ensure a safe and stable power supply for the circuit associated with the chair 100. Further, the chair 100 may include a control device or control panel 126 including one or more buttons, switches, or other control options accessible to a user to control power delivery to the heat exchangers 120.

In some implementations, each heat exchanger 120 may include one or more thermoelectric modules. In one implementation, the thermoelectric modules may be implemented as Peltier devices, which may draw heat away from the fabric in response to a first current, and which may deliver heat to the fabric in response to a second current. In one example, the first current may flow in a first direction through the thermoelectric modules to produce a cooling effect, and the second current may flow in a second direction through the thermoelectric modules to produce a warming effect.

Each thermoelectric module may be controlled by an electrical signal. The direction of flow of the signal (such as a current) may determine whether the thermoelectric element provides a warming effect or a cooling effect, and the magnitude of the signal may determine the amount of heating or cooling. Further, a differential cooling effect (such as a difference of negative ten degrees Fahrenheit relative to an ambient temperature) may be provided by a first electrical signal having a first amplitude and a first direction, and an equivalent differential warming effect may be provided by a second electrical signal having a second amplitude (that is less than the first amplitude) and a second direction that is opposite the first direction.

In an example, each heat exchanger 120 may include a plurality of thermoelectric modules arranged in series. When a signal is applied, the heat exchangers 120 may provide a cooling effect to the backrest 116, the seat 114, the armrest 118, or any combination thereof. When the signal is reversed, the heat exchangers 120 may provide a warming effect. In some implementations, the signal to provide the cooling effect may have a greater amplitude than the reversed signal to provide the warming effect.

Figure 2:
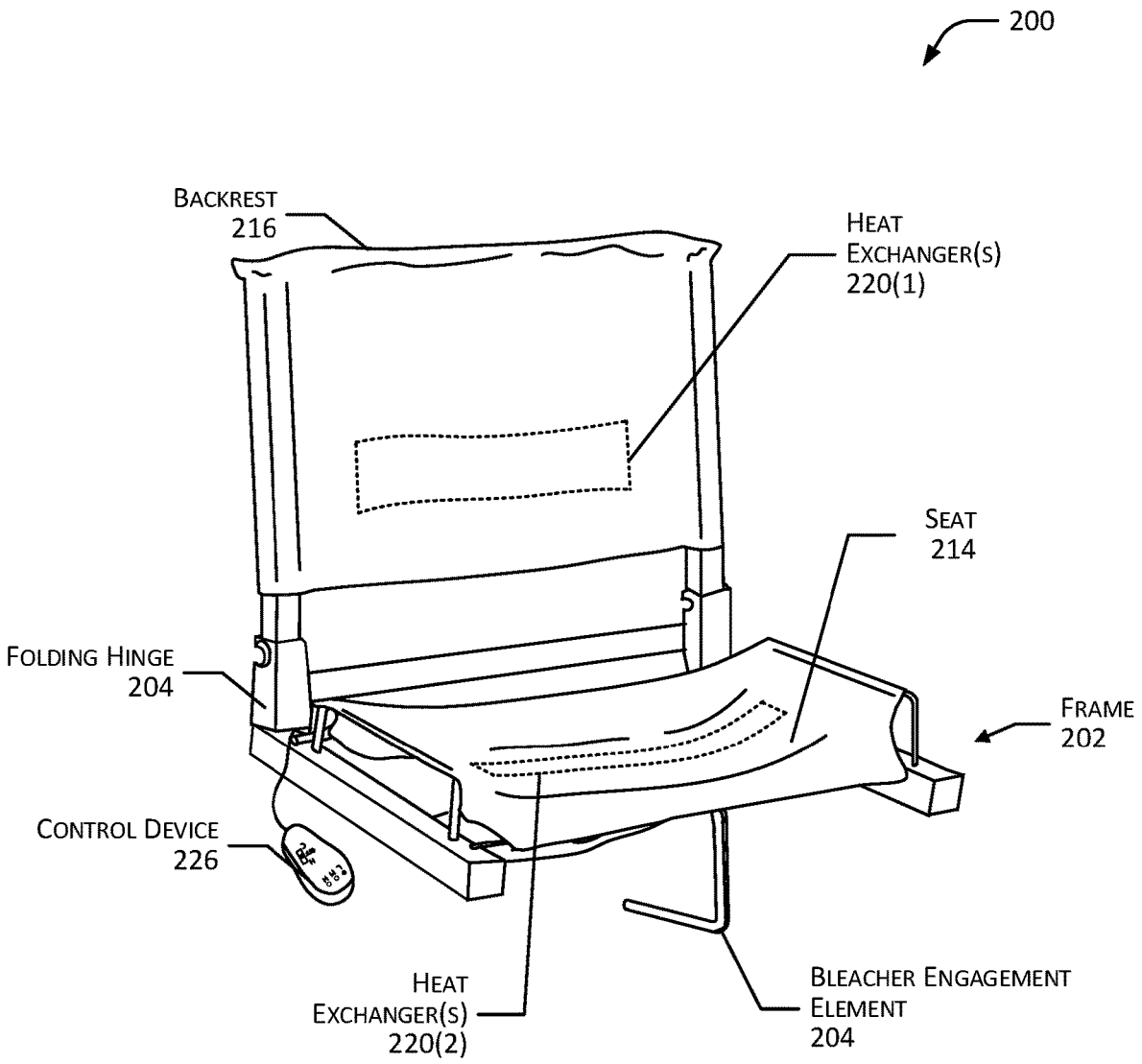
FIG. 2 depicts a perspective view of a portable, collapsible chair with integrated thermal management that is configured to couple to a bleacher seat or bench, in accordance with certain embodiments of the present disclosure.

FIG. 2 depicts a perspective view of a portable, collapsible chair 200 with integrated thermal management that is configured to couple to a bleacher seat or bench, in accordance with certain embodiments of the present disclosure. Unlike the chair 100 of FIG. 1, the chair 200 may be implemented as a bleacher seat that does not have any legs and that is configured to rest on a bleacher or plank or on a folding seat or chair. In an example, the chair 200 may be placed onto an existing seat or chair.

The chair 200 may include a frame 202, which may support a seat 214 and a backrest 216. The frame 202 may also include a folding hinge 204, which allows the seat 214 and the backrest 216 to fold toward one another to facilitate portability. In this example, the seat portion 214 and the backrest portion 216 are formed by a fabric stretched over the frame 202. In other implementations, the seat 214 and the backrest 216 may be padded.

The chair 200 may include one or more heat exchangers 220, which may be positioned on or within the backrest 216, the seat 214, or both. While only one heat exchanger 220(1) is shown within the backrest 216, more than one heat exchanger 220(1) may be provided within the backrest 216. Similarly, while only one heat exchanger 220(2) is shown within the seat 214, more than one heat exchanger 220(2) may be provided within the seat 214. Other implementations are also possible.

In the illustrated example, the chair 200 is shown without armrests. In other implementations, the chair 200 may include armrests, and each armrest may include a heat exchanger 220. Other implementations are also possible.

In some implementations, the chair 200 may include a control device 226, which may be coupled to the heat exchangers 220 through one or more wires. In this implementation, the control panel or device 226 may include lights or other optical indicators to indicate an operating mode and warming or cooling level of the heat exchangers. In some implementations, the control panel or device 226 may include an audible indicator in lieu of or in addition to the optical indicators. The control panel or device 226 may include one or more control options accessible by the user to control the operating mode or the warming or cooling settings.

While the control panel or device 226 is depicted as having a wired connection, other implementations are also possible. In one example, the control panel or device 226 may communicate wirelessly with a control circuit of the seat 200 to send signals to control the thermal operation of the seat 200. In another example, the control panel or device 226 may be integrated into a portion of the frame 202 or into the armrest. In still other implementations, the control panel or device 226 may be implemented as a software application executing on a computing device, such as a smartphone. Other implementations are also possible.

In some implementations, the user may activate the thermoelectric modules of the heat exchangers 120 of the chair 100 in FIG. 1 or the chair 200 in FIG. 2 while the chair is in a folded state, allowing the chair to be warmed or cooled during transport so that the chair 100 or 200 is ready for use when the user arrives at the destination. Other implementations are also possible.

It should be appreciated that each heat exchangers 120 in FIG. 1 and the heat exchangers 220 in FIG. 2 may respond to electrical signals to warm or cool the fabric of the seat 114, the backrest 116, the armrests 118, or any combination thereof. In other implementations, the heat exchanger 120 may utilize a circulating fluid. One possible example of a chair that utilizes a circulating fluid is described below with respect to FIG. 3.

Figure 3:
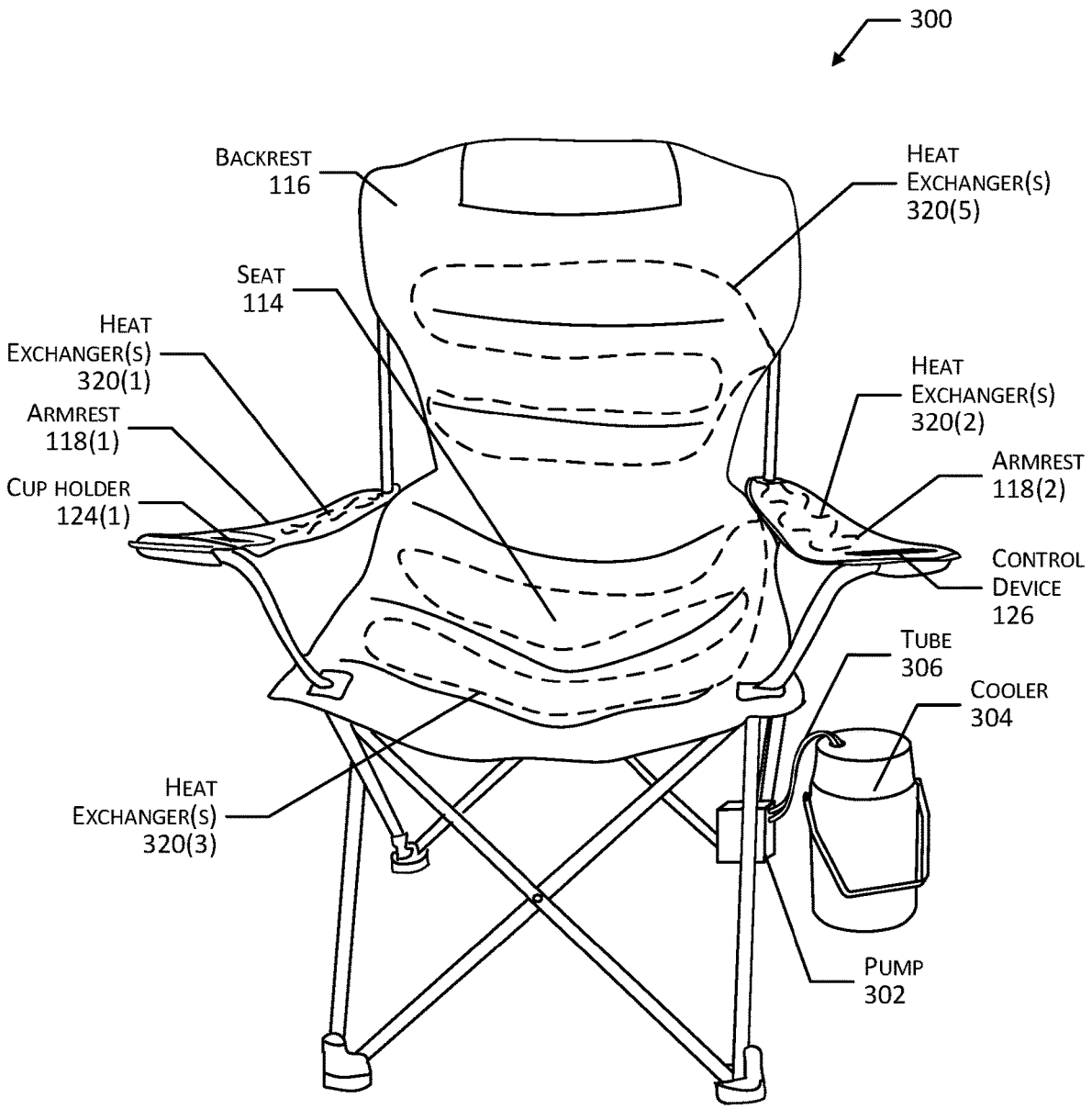
FIG. 3 depicts a perspective view of a portable, collapsible chair with integrated thermal management using circulating fluid, in accordance with certain embodiments of the present disclosure.

FIG. 3 depicts a perspective view of a system including a portable, collapsible chair 300 with integrated thermal management using circulating fluid, in accordance with certain embodiments of the present disclosure. In this example, the chair 300 may include pump 302 coupled by a tube 306 to a cooler 304. The pump 302 may be configured to draw fluid from the cooler 304 and to circulate the fluid through one or more heat exchanger 320. In this example, the tube 306 may have a first thermal characteristic that insulates the fluid from the environment, while tubing forming the heat exchangers 320 may have a second thermal characteristic that allows for transfer of heat from or into the fluid. Other implementations are also possible.

In the illustrated example, the chair 300 may include a control device 126 coupled to or integrated with the armrest 118(2). In this example, the control device 126 may generate electrical signals to control operation of the pump 302. In an example, the control device 126 may provide a signal to adjust a speed of the pump 302. Other implementations are also possible.

By circulating fluid from the cooler 304 through the heat exchangers 320, the surface temperature of the seat 114, the backrest 116, and the armrests 118 may be adjusted. In one example, ice water from the cooler 304 may be circulated through the heat exchanger 320 to reduce the surface temperature. In another example, hot water from the cooler 304 may be circulated through the heat exchanger to increase the surface temperature. It should be appreciated that the heat exchangers 320 may distributed through various parts of the chair 300, by positioning the tubing.

In the illustrated examples of FIGS. 1-3, the heat exchangers 120, 220, and 320 are depicted in various areas of the chairs 100, 200, and 300 in FIGS. 1-3. It should be appreciated that certain areas of the human body may be more sensitive to warming or cooling sensations, and the heat exchangers 120, 220, or 320 may be positioned to take advantage of such sensitivity. For example, one of the heat exchangers 120, 220, or 320 may be positioned along a front edge of the seat 114 or 214 to deliver a selected thermal effect to the back of the user's legs near the user's knees. Another of the heat exchangers 120, 220, or 320 may be positioned at a level of the shoulder blades or slightly below that level along the backrest 116 or 216 to deliver the selected thermal effect to the user's back. Others of the heat exchangers 120, 220, or 320 may be positioned in the armrests 118 to deliver the selected thermal effect to the user's forearms. In an example, at least a portion of one of the heat exchangers 120, 220, or 320 may be positioned within the armrests 118 in an area that may correspond to the user's wrists.

On a hot summer day, such as when temperatures exceed 95 degrees Fahrenheit, the heat exchangers 120, 220, or 320 may operate to provide a cooling effect. In some implementations, the cooling effect may be a temperature difference of about 10 degrees or more below the ambient temperature (or below a user's body temperature). Similarly, a warming effect may be a temperature difference of about 10 degrees or more above the ambient temperature (or above the user's skin or body temperature). The electrical signals or fluid flow may be controlled to provide a selected temperature differential. In the case of the electrical signals, the direction of the electrical signals may determine the mode (warming mode or cooling mode) and the amplitude of the electrical signals may determine the amount of warming or cooling (e.g., the size of the temperature differential).

In some implementations, the heat exchangers 120, 220, or 320 may be positioned relative to the seat 114, the backrest 116, and the armrests 118 to deliver a selected thermal effect to thermoreceptors of a user. The term "thermoreceptors" refers to nerve endings in a person's skin and muscles that carry temperature sensations via the same nerve fibers that carry pain information to the spinal cord. In general, thermoreceptors are called phasic-type receptors that respond rapidly to minute changes in temperature but that adapt and quit firing as the temperature of the receptor reaches steady state. In other words, the user may become desensitized to a stable cooling or warming temperature. To enhance the user's experience, a control circuit may vary the current flow (or the fluid flow) through the heat exchangers 120, 220, or 320 so that the heat exchangers 120, 220, or 320 do not reach a steady state, and thus prevent the thermoreceptors from becoming desensitized.

The thermoreceptors may be located in the dermis of the skin. A cold environment may result in lesser blood flow near the surface, making the body feel cooler. Different parts of the body may have different temperature sensitivity levels and may be more receptive to thermal stimulation than others. For example, certain areas of the body, such as the neck, back of the knees, forearms, and so on may be more sensitive to thermal effects than others, and the heat exchangers 120, 220, or 320 may be positioned accordingly. In some implementations, the heat exchangers 120, 220, or 320 may be fixed to selected locations on the backrest 116 or 216, the seat 114 or 214, the armrests 118, and so on. In other implementations, the heat exchangers 120, 220, or 320 may be adjustable, allowing the user to adjust the location of the heat exchangers 120, 220, or 320 to enhance the performance. In an example, the one or more heat exchangers 120, 220, or 320 may be secured in one or more fabric pouches, which may releasably secure the exchangers. The user may move the heat exchangers 120, 220, or 320 from a first fabric pouch to a second fabric pouch coupled, for example, to the backrest 116 or 216 to adjust the relative position of the heat exchangers. Alternatively, the fabric pouch may attach by Velcro or another means, allowing the user to detach the fabric pouch from a first location on the backrest 116 or 216 and to reattach the fabric pouch at a second location on the backrest 116 or 216 to reposition the heat exchanger. Other implementations are also possible.

Figure 4:
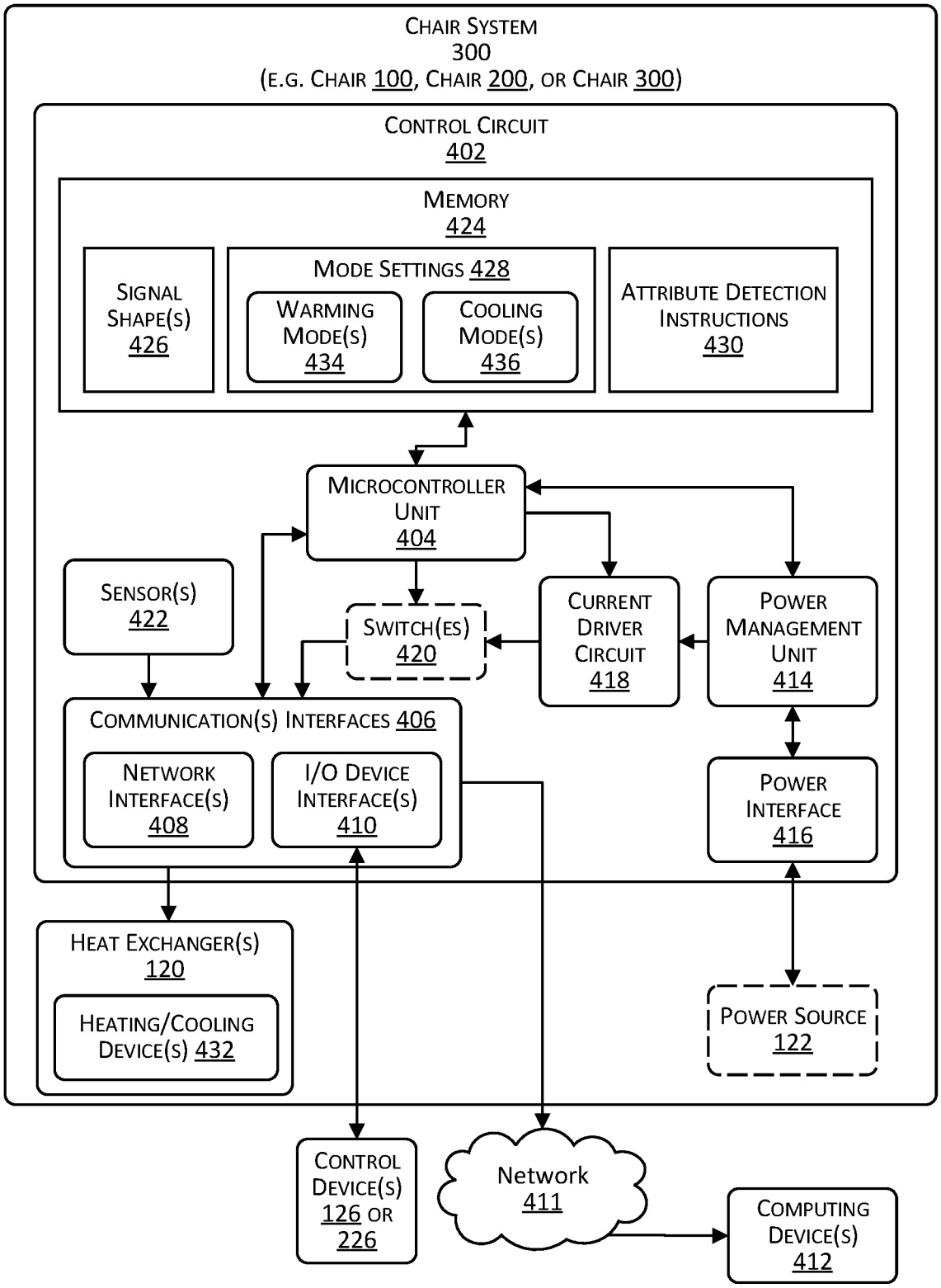
FIG. 4 depicts a block diagram of a system including control circuitry coupled to or integrated with the chair of FIG. 1, in accordance with certain embodiments of the present disclosure.

FIG. 4 depicts a block diagram of a chair system 400 (such as the chair 100 of FIG. 1, the chair 200 of FIG. 2, or the chair 300 of FIG. 3) including control circuitry 402, in accordance with certain embodiments of the present disclosure. The control circuit 402 may include a microcontroller unit 404 which may be coupled to one or more communications interfaces 406. The communications interfaces 406 may include a network interface 408, which may be configured to communicate with a remote device, such as a computing device 412 through a communication network 411, such as a Bluetooth® communication network, the Internet, or another communication network. The communications interfaces 406 may also include an input/output device interface 410, which may include a universal serial bus (USB) interface or other interfaces that may enable communication with an external device, such as the computing device 412, through a wired connection. In some implementations, the computing device 412 may include a tablet computer, a smartphone, a wearable device, another computing device, or any combination thereof.

The control circuit 402 may include a power management unit 414 coupled to the microcontroller unit 404 and coupled to a power interface 416. The power interface 416 may be coupled to a power source 122, such as a rechargeable battery. The power management unit 414 may supply power to the control circuit 402 and may provide clock signals as well as reference voltages.

The control circuit 402 may further include a current driver circuit 418 including a first input coupled to the power management unit 414 to receive a power supply, a second input coupled to the microcontroller unit 404 to receive control signals, and an output coupled to the communications interfaces 406 through one or more switches 420. The switches 420 may include a first input to receive a current signal from the current driver circuit 418, a control input to receive a switch control signal from the microcontroller unit 404, and an output coupled to the communications interfaces 406.

The communications interfaces 406 may be coupled to one or more sensors 422. The one or more sensors 422 may include temperature sensors, pressure sensors, optical sensors, other sensors, or any combination thereof. The one or more sensors 422 may be coupled to the microcontroller unit 404 via the I/O device interfaces 410. In some implementations, the I/O device interfaces 410 may include one or more analog-to-digital converters (ADCs) to convert analog sensor signals into digital data. Each of the sensors 422 may provide an electrical signal to the microcontroller unit 404 that is proportional to a sensed parameter.

The communications interfaces 406 may be coupled to one or more heat exchangers 120. In this example, the communication interfaces 406 may provide one or more control signals to heating/cooling devices 432, which may deliver a selected thermal effect (heating or cooling) to a surface of the chair 100, 200, or 300. In an alternative embodiment, the communications interfaces 406 may provide a control signal to a pump to circulate a thermal fluid to the heat exchangers 120. The heat exchangers 120 may also include one or more fans 434, which may be activated to circulate air across the heating/cooling devices 432, across a fluid-circulating tube, and so on. In some implementations, one or more of the fans 434 may circulate air over the surface of the backrest 116 or 216, the seat 114 or 214, the armrest 118, or any combination thereof. Other implementations are also possible.

The control circuit 402 may include a memory 424 to store data and optionally to store instructions that may be executed by the microcontroller unit 404 to provide a plurality of functions. The memory 424 may include a current signal shape module 426 that, when executed, may cause the microcontroller unit 404 to generate a control signal to the current driver circuit 418 having a selected shape. In a particular example, the microcontroller 404 may execute the current signal shape module 426 to generate a time-varying signal, such as a square wave signal, a ramp signal, a sinusoidal signal, an irregular signal, a triangle signal, or another signal shape. The microcontroller 404 may also provide switch signals to the one or more switches 420 to drive the heat exchangers 120 using the signal having the selected shape. In some implementations, the microcontroller 404 may provide different signals to each of a plurality of heat exchangers 120. The signals may differ in timing, amplitude, phase, shape, or any combination thereof. Other implementations are also possible.

The memory 424 may also include one or more mode settings 428 that may be used by the microcontroller unit 404 to determine an operating state of the heat exchangers 120, the pump 302, the control circuit 402, or any combination thereof. The mode settings 428 may cause the microcontroller 404 to determine a current state of the chair system 400 and to turn off the circuit 402 when the state is greater than or equal to a first threshold. The mode settings 428 may cause the microcontroller 404 to increase or decrease current flow to the heat exchangers 120 depending on the state is greater than or equal to a second threshold, and so on.

In some implementations, the microcontroller unit 404 may control the power management unit 414, the current driver circuit 418, and the switches 420 to deliver a first electrical signal to a first heat exchanger 120(1), a second electrical signal to a second heat exchanger 120(2), and so on. In some implementations, the first and second electrical signals may differ in amplitude, frequency, duration, and so on. The first and second electrical signals may be asynchronous. In other implementations, a first waveform may be provided to the first heat exchanger 120(1), and a second waveform may be provided to the second heat exchanger 120(2). The first and second waveforms may different in shape, frequency, amplitude, period, duration, or any combination thereof. For example, a substantially constant electrical signal may be provided to a heat exchanger 120 in the seat 114 or 214 of the chair 100 or 200, while a one-half or one-third duty cycle signal may be sent to the heat exchangers 120 in the armrests 118. Other implementations and other variations are also possible.

In some implementations, each heat exchanger 120 may include a plurality of the heating/cooling devices 432 (thermoelectric elements) arranged in series to form a circuit or loop. Drive circuitry of the communication interfaces 406 may apply a signal to the circuit or loop to provide a warming effect or may reverse the signal applied to the circuit or loop to provide a cooling effect.

In another implementation, the plurality of heating/cooling devices 432 (thermoelectric elements) within each heat exchanger 120 are coupled to one of a first circuit or loop or a second circuit or loop. The heating/cooling devices 432 may be interleaved or alternated such that a first heating/cooling device 432 is coupled to the first circuit, a second heating/cooling device 432 is coupled to the second circuit, a third heating/cooling device 432 is coupled to the first circuit, and so on. A signal applied to the first, third, and fifth heating/cooling devices 432 may cause the devices 432 to provide a warming effect. A signal applied to the second, fourth, and sixth heating/cooling devices 432 may cause the devices 432 to provide a cooling effect. The microcontroller unit 404 may switch between the first circuit or the second circuit based on the selected operating mode.

Figure 5A:
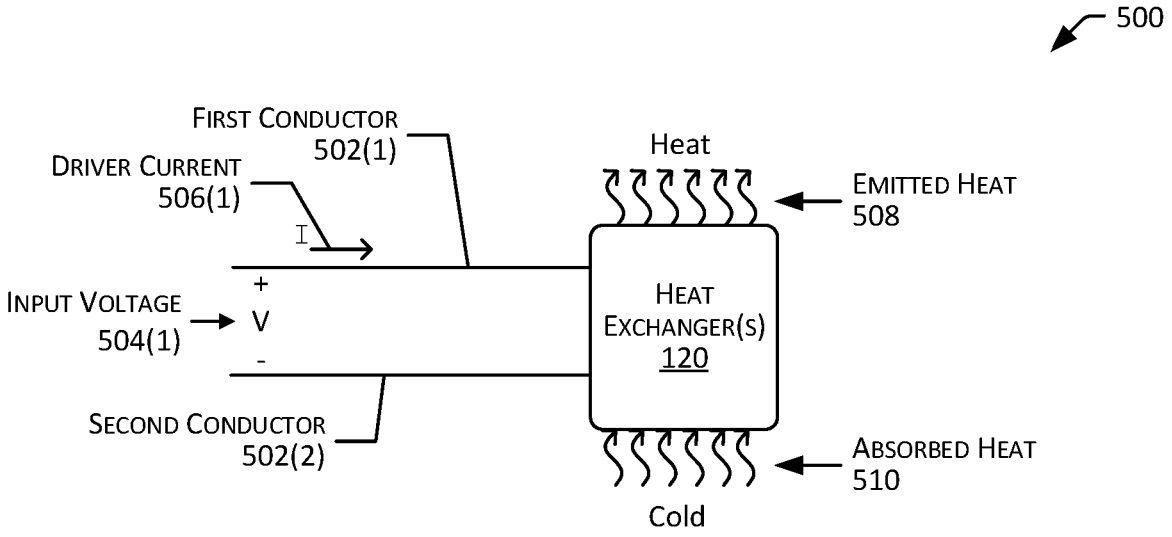
FIGS. 5A, 5B, and 5C depict block diagrams of heat exchangers, in accordance with certain embodiments of the present disclosure.
Figure 5B:
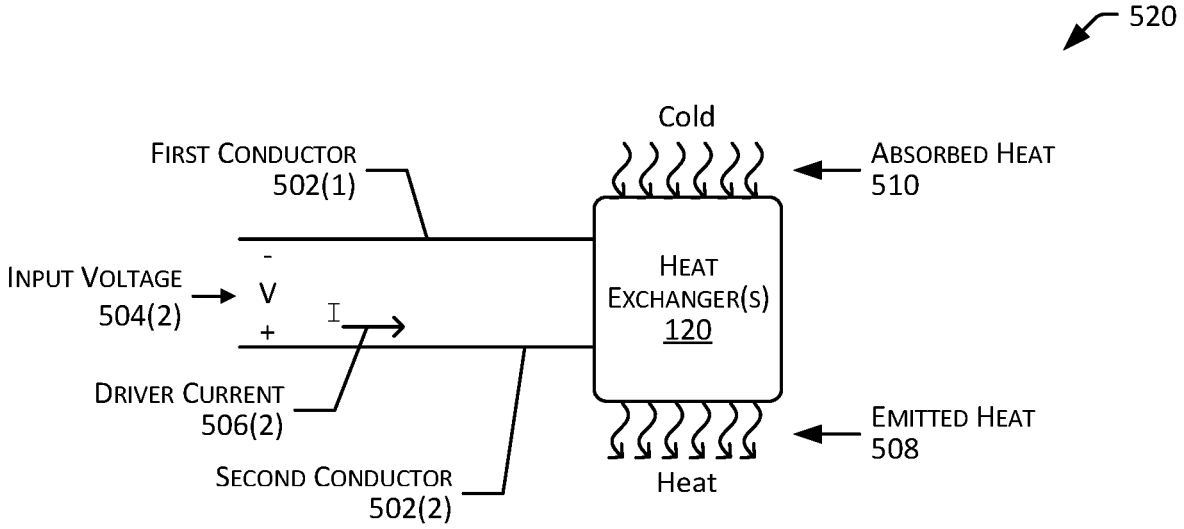
Figure 5C:
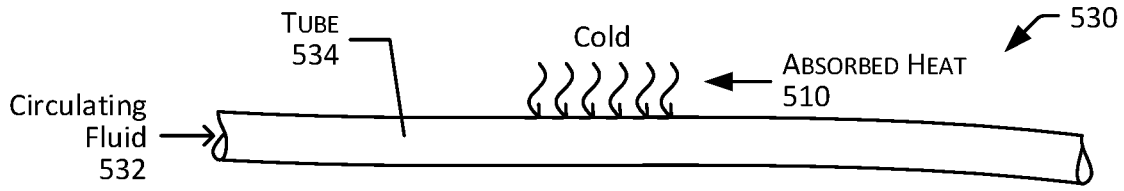

FIGS. 5A, 5B, and 5C depict block diagrams of heat exchangers, in accordance with certain embodiments of the present disclosure. In FIG. 5A, a heat exchanger system 500 is shown. The heat exchanger system 500 includes a heat exchanger 120 coupled to a first conductor 502(1) and a second conductor 502(2), which provide an input voltage 504(1) having a first polarity and which carry a driver current 506(1). In response to the input voltage 504(1), the heat exchanger 120 may emit heat 508 on a first side and may absorb heat 510 on a second side. In this example, the heat exchanger 120 may include one or more thermal devices, such as Peltier devices.

In FIG. 5B, a heat exchanger system 520 is shown. The heat exchanger system 520 is the same as the heat exchanger system 500 of FIG. 5A, except the polarity of the input voltage is reversed, as indicated by input voltage 504(2) and the driver current 506(2) is reversed. In response to the reversed polarity, the heat exchanger 120 may absorb heat 510 on the first side and emit heat 508 on the second side.

In FIG. 5C, a heat exchanger system 530 is shown in which the electrical heat exchanger 120 is replaced with a tube 534 that carries a circulating fluid 532. The circulating fluid 532 may be cooled or heated to a desired temperature and placed in a thermal container. The circulating fluid 532 may then be pumped through a lumen of the tube 534. In this example, the circulating fluid 532 may be cooler than ambient temperature, and absorbed heat 510 may be captured through the tube 534 and dissipated in the circulating fluid 532 to provide a cooling effect. Alternatively, a warmed or heated fluid may be circulated through the tube 534 to provide a warming effect. Other implementations are also possible.

Figure 6A:
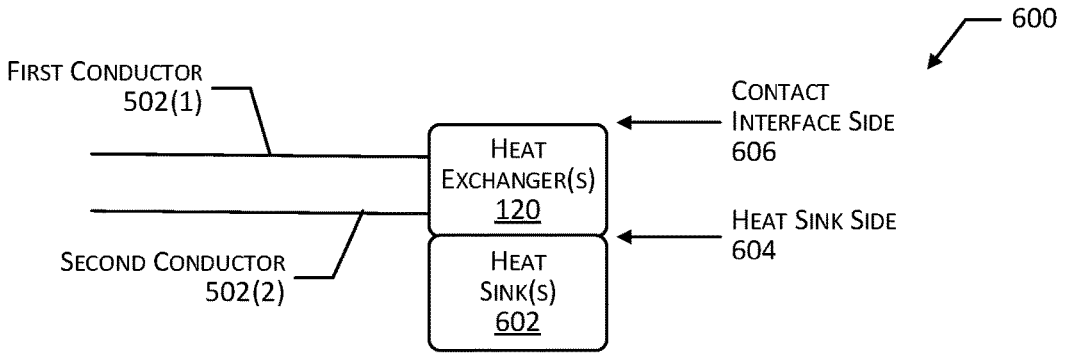
FIG. 6A depicts a block diagram of a heat exchanger, in accordance with certain embodiments of the present disclosure.

FIG. 6A depicts a block diagram of a heat exchanger assembly 600, in accordance with certain embodiments of the present disclosure. The assembly 600 may include one or more heat exchangers 120, each of which may be coupled to a first conductor 502(1) and a second conductor 502(2). The one or more heat exchangers 120 may be coupled to one or more heat sinks 602. The heat exchangers 120 may be coupled to the heat sinks on a heat sink side 604 that is opposite to a contact interface side 606 of the heat exchanger.

During use, the heat exchanger 120 may create a differential temperature between the contact interface side 606 and the heat sink side 604. The differential temperature may be based on the amplitude and direction of the electric signal applied to the conductors 502. The heat sink 604 may operate to clamp a temperature at the heat sink side 604 to approximately an ambient temperature, forcing the interface side 606 to present the differential temperature relative to the ambient temperature.

In one particular non-limiting example, in a cooling mode, the circuit may apply different voltage levels to achieve a differential cooling effect. In a low mode, the signal may have a voltage amplitude of approximately 1 volt to achieve a 10-degree differential temperature. In a medium mode, the signal may have a voltage of approximately 2 volts to achieve a 15- to 18-degree differential temperature. In a high mode, the signal may have a voltage of approximately 3 volts to achieve a 20- to 24-degree temperature differential. Other voltage levels are also possible to achieve other cooling effects.

Extending the same non-limiting example, in a warming mode, the circuit may also apply different voltage levels to achieve a differential warming effect. In a low mode, the signal may have a voltage amplitude of approximately 0.5 volts to achieve a 10-degree differential temperature. In a medium mode, the signal may have a voltage of approximately 0.9 volts to achieve a 15- to 20-degree differential temperature. In a high mode, the signal may have a voltage of approximately 1.3 volts to achieve a 20- to 24-degree temperature differential. In this example, the thermoelectric elements may generate 10, 15, and 20 degrees of warming effect at lower voltages and lower currents than the same thermoelectric element produces the same 10, 15, and 20 degrees of cooling effect.

There is some variability in the thermoelectric modules 432 such that the current/voltage amplitudes required to achieve the selected temperature differential may vary between manufacturing lots. In one implementation, the voltage and current settings may be configured for the thermoelectric modules 432 during manufacturing. In another implementation, the voltage and current settings may be configured by the microcontroller unit (MCU) 410 based on signals from the sensors 422. Other implementations are also possible.

Figure 6B:
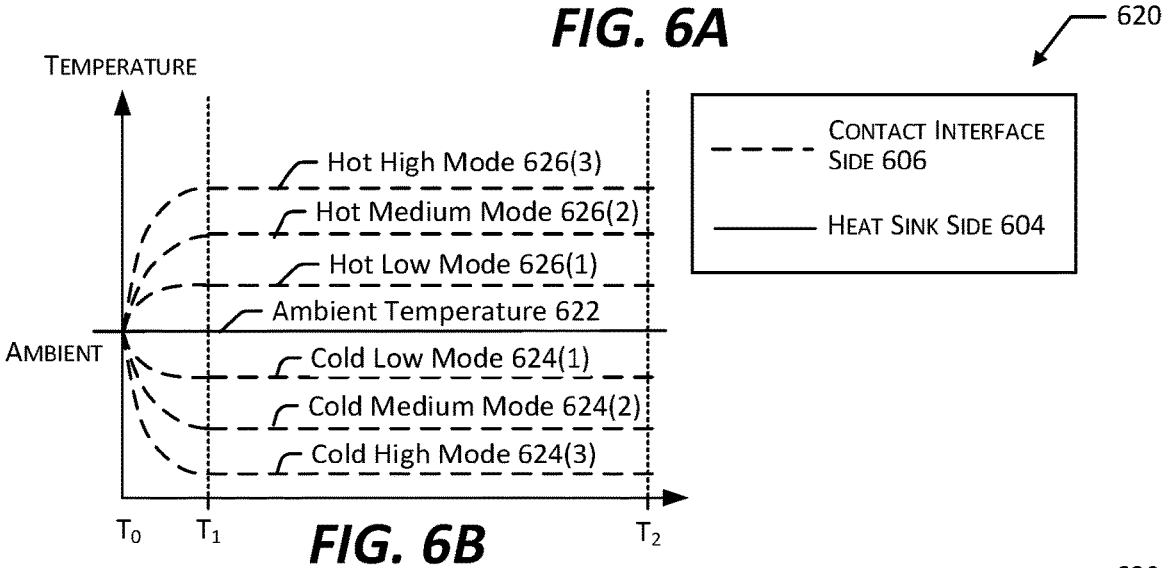
FIGS. 6B-6C depict graphs of temperature and signal amplitude versus time, respectively, for at least one of the heat exchangers in different operating modes, in accordance with certain embodiments of the present disclosure.
Figure 6C:
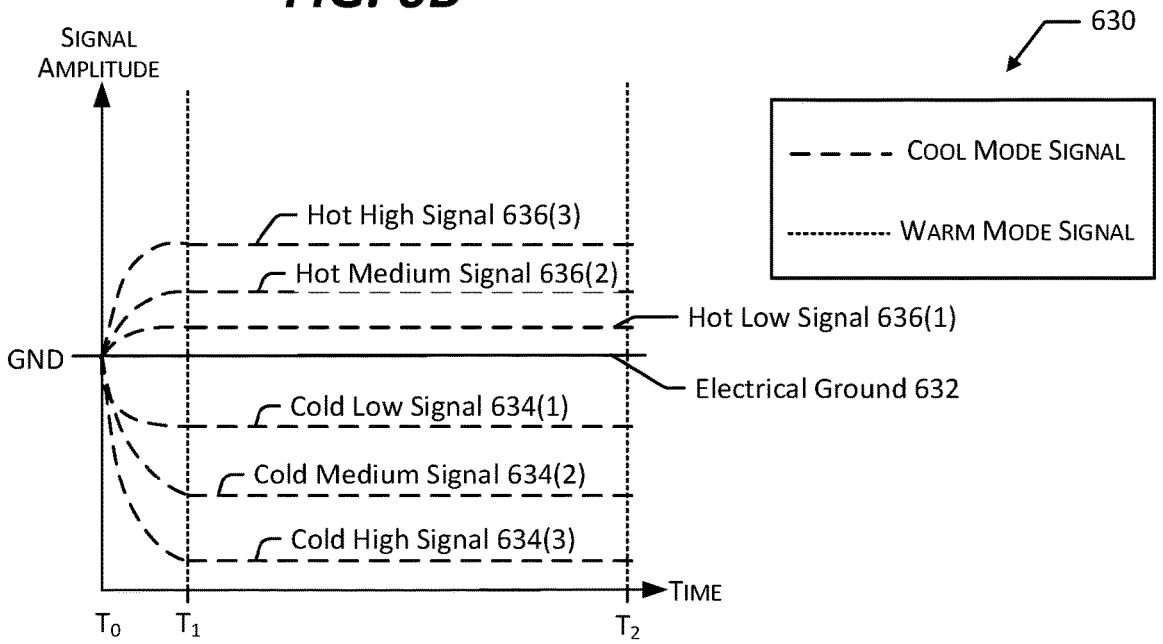

FIGS. 6B-6C depict graphs of temperature and signal amplitude versus time, respectively, for at least one of the heat exchangers in different operating modes, in accordance with certain embodiments of the present disclosure. In FIG. 6A, a graph 620 depicts temperature over time for different modes (warming and cooling) of the thermoelectric modules 432.

The graph 620 shows ambient temperature 622. The graph 620 also shows a cold low mode 624(1), a cold medium mode 624(2), and a cold high mode 624(3). The cold low mode 624(1) may provide approximately a 10-degree temperature differential, the cold medium mode 624(2) may provide approximately a 15- to 20-degree temperature differential, and the cold high mode 624(3) may provide approximately a 20- to 25-degree temperature differential. Other implementations are also possible.

The graph 620 also depicts the warming mode, including the hot low mode 626(1), the hot medium mode 626(2), and the hot high mode 626(3). The hot low mode 626(1) may provide an 8- to 10-degree temperature differential, the hot medium mode 626(2) may provide a 15- to 20-degree temperature differential, and the hot high mode 626(3) may provide a 20- to 25-degree temperature differential.

In FIG. 6C, a graph 630 depicts signal amplitudes relative to electrical ground (GND) 632. Negative signals (i.e., signals below electrical ground 632) reflect a signal sent in a first direction through the thermoelectric elements 432 to provide a cooling effect, while positive signals (i.e., signals above electrical ground 632) reflect a reverse signal sent in a second direction through the thermoelectric elements 432 to provide a warming effect. Alternatively, thermoelectric modules 432 within a heat exchanger 120 may be alternatively coupled to a first electrical circuit or a second electrical circuit to provide a first subset and a second subset, such that the warming effect is provided by applying a signal to the first subset and the cooling effect is provided by applying a signal to the second subset. Other implementations are also possible.

In the illustrated example, the graph 630 depicts a cold low signal 634(1), a cold medium signal 634(2), and a cold high signal 634(3). While the cold mode signals 634 are depicted as being substantially uniformly different, depending on the implementation, the differences between the cold level signals 634 may vary such that a larger change in amplitude is applied to achieve the temperature differential between the cold medium mode 624(2) and the cold high mode 624(3). Other implementations are also possible.

The graph 630 also depicts a hot low signal 636(1), a hot medium signal 636(2), and a hot high signal 636(3). The hot low signal 636(1) may have a first differential amplitude relative to electrical ground 632. The hot medium signal 636(2) may have a second differential amplitude relative to the hot low signal 636(1). In the illustrated example, the second differential amplitude is greater than the first differential amplitude. The hot high signal 636(3) may have a third differential amplitude relative to the hot medium signal 636(2). The third differential amplitude may be greater than the second differential amplitude. In other implementations, the third differential amplitude may be less than the second differential amplitude, which may be less than the first differential amplitude. In still another implementation, the first, second, and third differential amplitudes may be the same. Other implementations are also possible.

Figure 7A:
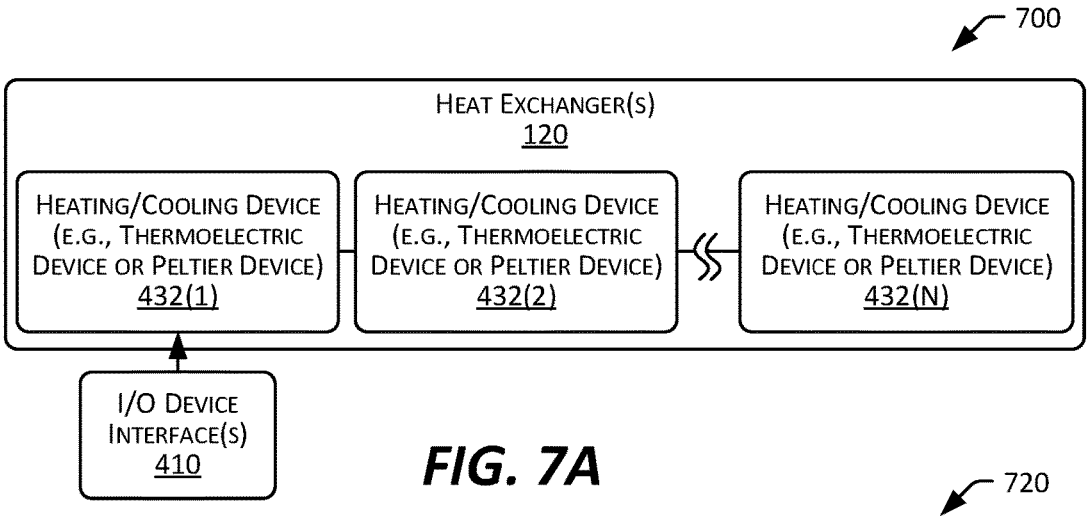
FIGS. 7A and 7B depict block diagram of devices including controllable heat exchangers coupled to or integrated with the chair of FIG. 1, in accordance with certain embodiments of the present disclosure.
Figure 7B:
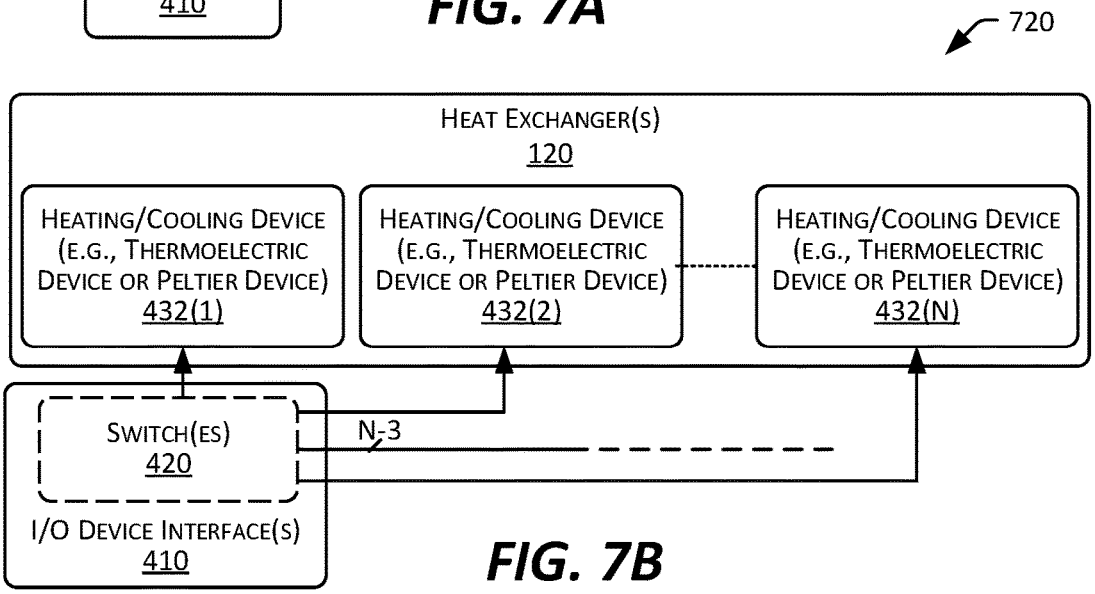

FIGS. 7A and 7B depict block diagram of devices including controllable heat exchangers coupled to or integrated with the chair 100 of FIG. 1 or the chair 200 of FIG. 2, in accordance with certain embodiments of the present disclosure. In FIG. 7A, a system 700 includes a heat exchanger 120 having a plurality of heating/cooling devices 432, which may be coupled to the I/O device interface 410 to receive an electrical signal. In this example, the heating/cooling devices 432, such as Peltier devices, may be coupled in series.

In FIG. 7B, the system 720 may include a heat exchanger 120 having a plurality of heating/cooling devices 432. The I/O device interface 410 may include a plurality of switches 420, which may enable the microcontroller 404 to send independent electrical signals to each of the heating/cooling devices 432. In an alternative example, the switches 420 may be coupled between the microcontroller unit 404 and the I/O device interfaces 410. Other implementations are also possible.

Figure 7C:
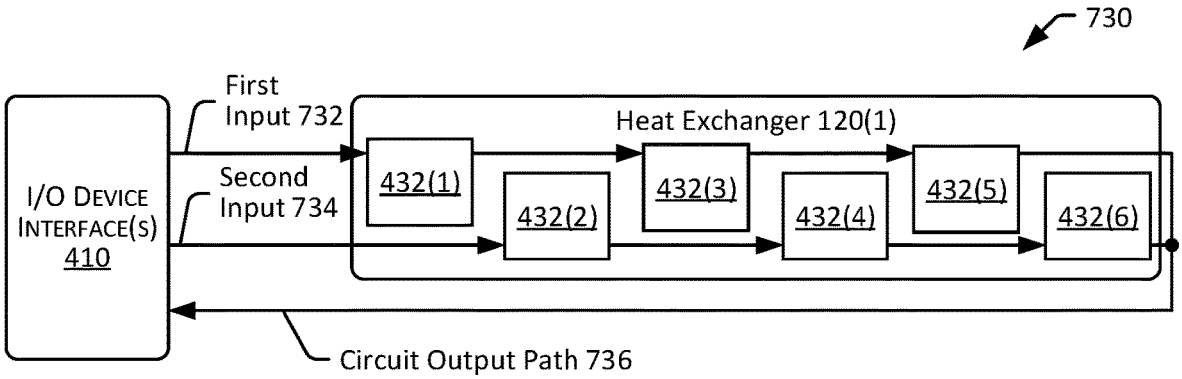
FIG. 7C depicts a block diagram of a heat exchanger formed of interleaved thermoelectric modules forming separate warming and cooling circuits, in accordance with certain embodiments of the present disclosure.

FIG. 7C depicts a block diagram of a system 700 including a heat exchanger 120 formed of interleaved thermoelectric modules 432 forming separate warming and cooling circuits, in accordance with certain embodiments of the present disclosure. In this example, thermoelectric modules 432(1), 432(3), and 432(5) are connected in series between a first input 732 and a circuit output path (return path) 736. Thermoelectric modules 432(2), 434(4), and 436(6) are connected in series between a second input 734 and the circuit output path 736. In this example, thermoelectric modules 432(1), 432(3), and 432(5) form a first circuit, and thermoelectric modules 432(2), 432(4), and 432(6) form a second circuit.

The first input 732, the second input 734, and the circuit output path 736 are coupled to the I/O device interfaces 410. It should be appreciated that the system 700 may include multiple heat exchangers 120, each of which may be controlled independently of the others by applying different signals to one of their respective first input 732 or second input 734.

In this example, by interleaving the thermoelectric modules 432, every other thermoelectric module 432 provides either warming or cooling. To warm the chair 100 or 200, the circuit 402 may apply a first signal to the first circuit. To cool the chair 100 or 200, the circuit 402 may apply a second signal to the second circuit. Other implementations are also possible.

Figure 8A:
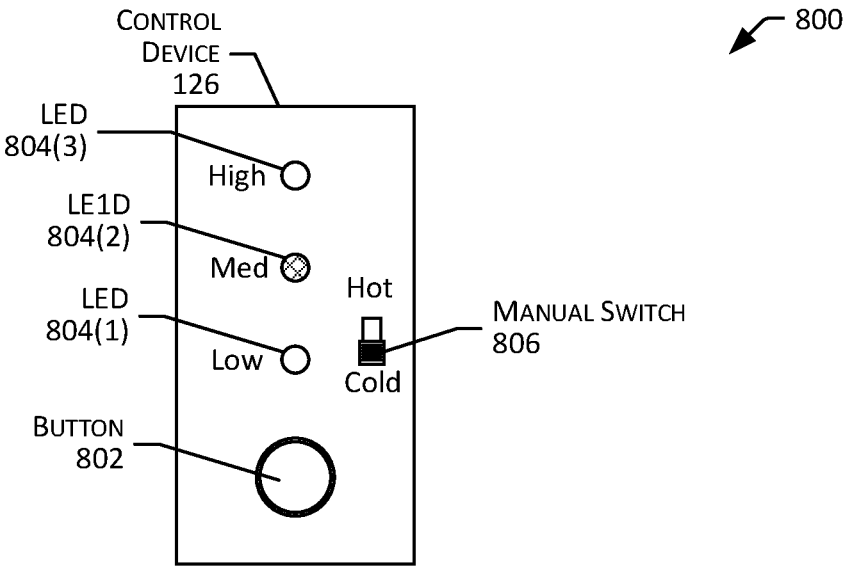
FIGS. 8A and 8B depict diagrams of control devices coupled to or integrated with the chairs of FIGS. 1-3, in accordance with certain embodiments of the present disclosure.
Figure 8B:
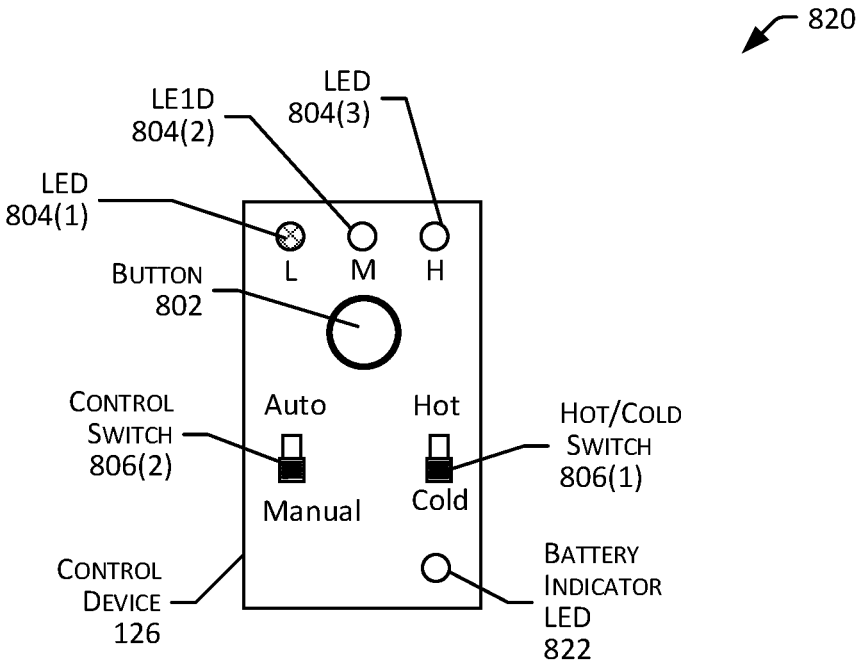

FIGS. 8A and 8B depict diagrams of control devices coupled to or integrated with the chairs 100 or 200 of FIGS. 1 and 2, in accordance with certain embodiments of the present disclosure. In FIG. 8A, a system 800 may include a control device 126, which may be accessed by a user to control a cooling effect of the heat exchangers 120. The control device 126 may include a button 802, light-emitting diodes (LEDs) 804, and a manual switch 806. In this example, the manual switch 806 may be accessed to switch between a hot mode and a cold mode. The button 802 may be accessed to switch between an off state, a low state, a medium state, and a high state. Other implementations are also possible.

The control device 126 may also include a fan switch 808, which may be accessed to turn a fan on or off. In an alternative embodiment, the fan switch 808 may include multiple settings, such as Off, low speed, medium speed, and high speed. In another implementation, instead of a switch, the control panel or device 126 may include a slider to enable continuously variable speed adjustment for the fan. Other implementations are also possible.

In FIG. 8B, a system 820 may include a control device 126 including a button 802, LEDs 804, a hot/cold switch 806(1), an automatic or manual control switch 806(2), and a battery LED 822. In this example, the battery LED 822 may provide an indicator of a state of the battery.

In a manual operating mode, the system 820 may respond to user inputs received via the control panel or device 126. In an automatic operating mode, the system 820 may cause the microcontroller unit 404 to control operation of the heat exchangers 120 automatically, such as in response to signals from the one or more sensors 422. For example, in a low state, the microcontroller unit 404 may control the heat exchangers 120 to maintain a temperature differential of approximately 10 degrees relative to the sensed temperature (e.g., 10 degrees cooler or 10 degrees warmer). In a medium state, the microcontroller unit 404 may control the heat exchangers 120 to maintain a temperature differential of approximately 15 degrees relative to the sensed temperature. In a high state, the microcontroller unit 404 may control the heat exchangers 120 to maintain a temperature differential of approximately 20 degrees relative to the sensed temperature. Other temperature differentials are also possible.

In some implementations, the microcontroller unit 404 may maintain the temperature differential by controlling a voltage or current supplied to the heat exchangers 120. In other implementations, the microcontroller unit 404 may send control signals to the pump 202 to achieve a selected temperature setting. Other implementations are also possible.

Figure 9A:
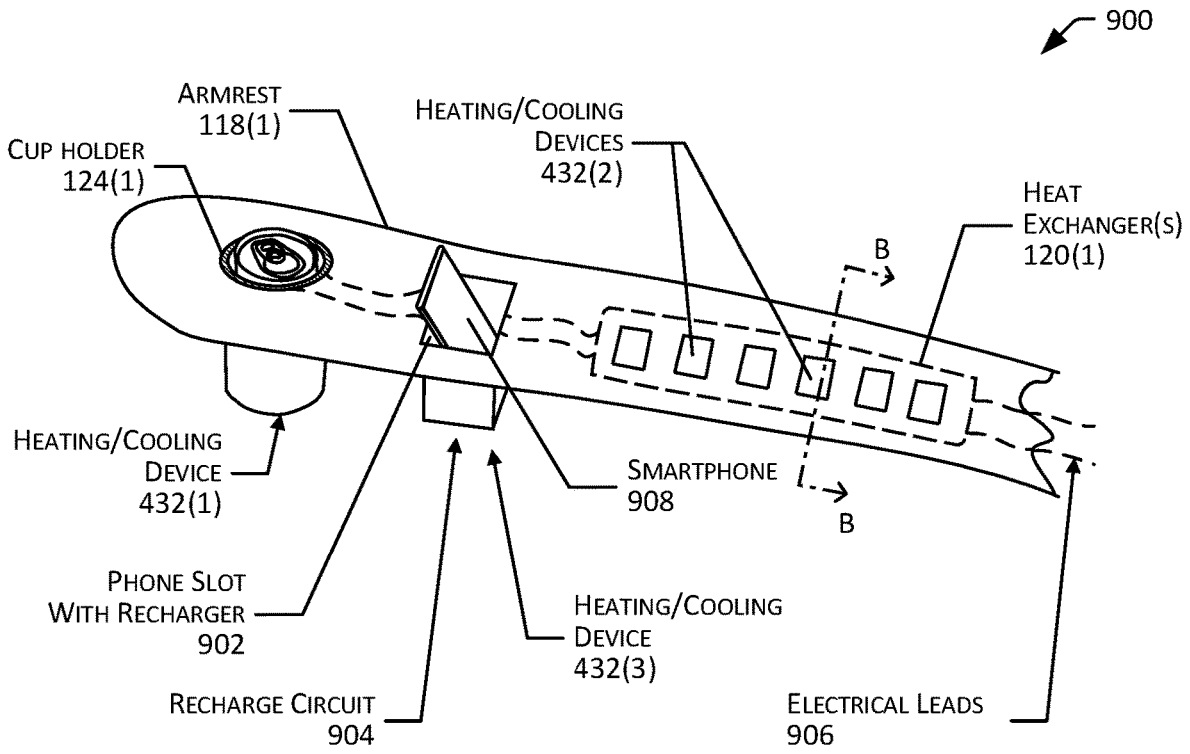
FIG. 9A depicts a portion of an arm of the chair of FIG. 1 including a cupholder, a phone slot and a heat exchanger, in accordance with certain embodiments of the present disclosure.

FIG. 9A depicts a portion 900 of an armrest 118 of the chair of FIG. 1 including a cupholder 124, a phone slot 902, and a heat exchanger 120, in accordance with certain embodiments of the present disclosure. In this example, the cupholder 124 is shown holding a soda can. The cup holder 124 may include a heating/cooling device 432(1) to cool or warm a drink in the cup holder 124.

The phone slot 902 may include a recharge circuit 904, which may include a universal serial bus (USB) port to which a smartphone 908, a tablet computer, or other device may be coupled to receive an electrical charge. The phone slot 902 may also include a heating/cooling device 432(3) to cool the smartphone 908 during recharging.

The armrest 118(1) also includes a heat exchanger 120(1) including a plurality of heating/cooling devices 432(2). Electrical leads 906 may extend from the power source 122 though legs 104 or supports 106 of the frame 102 and into the armrest 118. Alternatively, the electrical leads may be coupled to the legs 104 or supports 106 of the frame 102 and optionally to the seat 114, the backrest 116, the armrest 118, or any combination thereof. The electrical leads 906 may supply power to the heat exchangers 120(1), the recharge circuit 904, and the heating/cooling devices 432, independently or in series. In some implementations, the recharge circuit 904 may be wired separately from the heating/cooling device 432. In other implementations, each heat/cooling device 316 may be controlled independently. Other implementations are also possible.

Figure 9B:
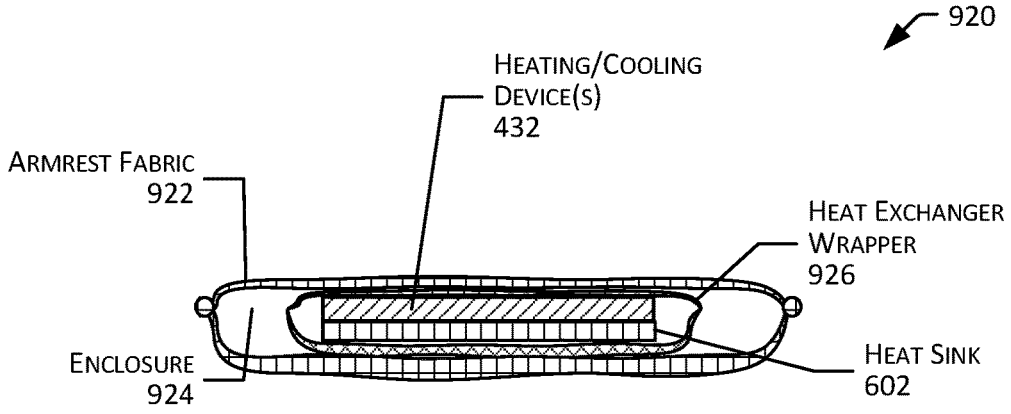
FIG. 9B depicts a cross-sectional view of a portion of the heat exchanger of FIG. 9A taken along line B-B.

FIG. 9B depicts a cross-sectional view 920 of a portion of the heat exchanger 120 of FIG. 9A taken along line B-B. In this example, the view 920 includes armrest fabric 922 forming an enclosure 924 around a heat exchanger wrapper 926, which may enclose heating/cooling device 432 and an associated heat sink 602. It should be appreciated that the cross-sectional view 920 is illustrative only, and other implementations are also possible.

Figure 10:
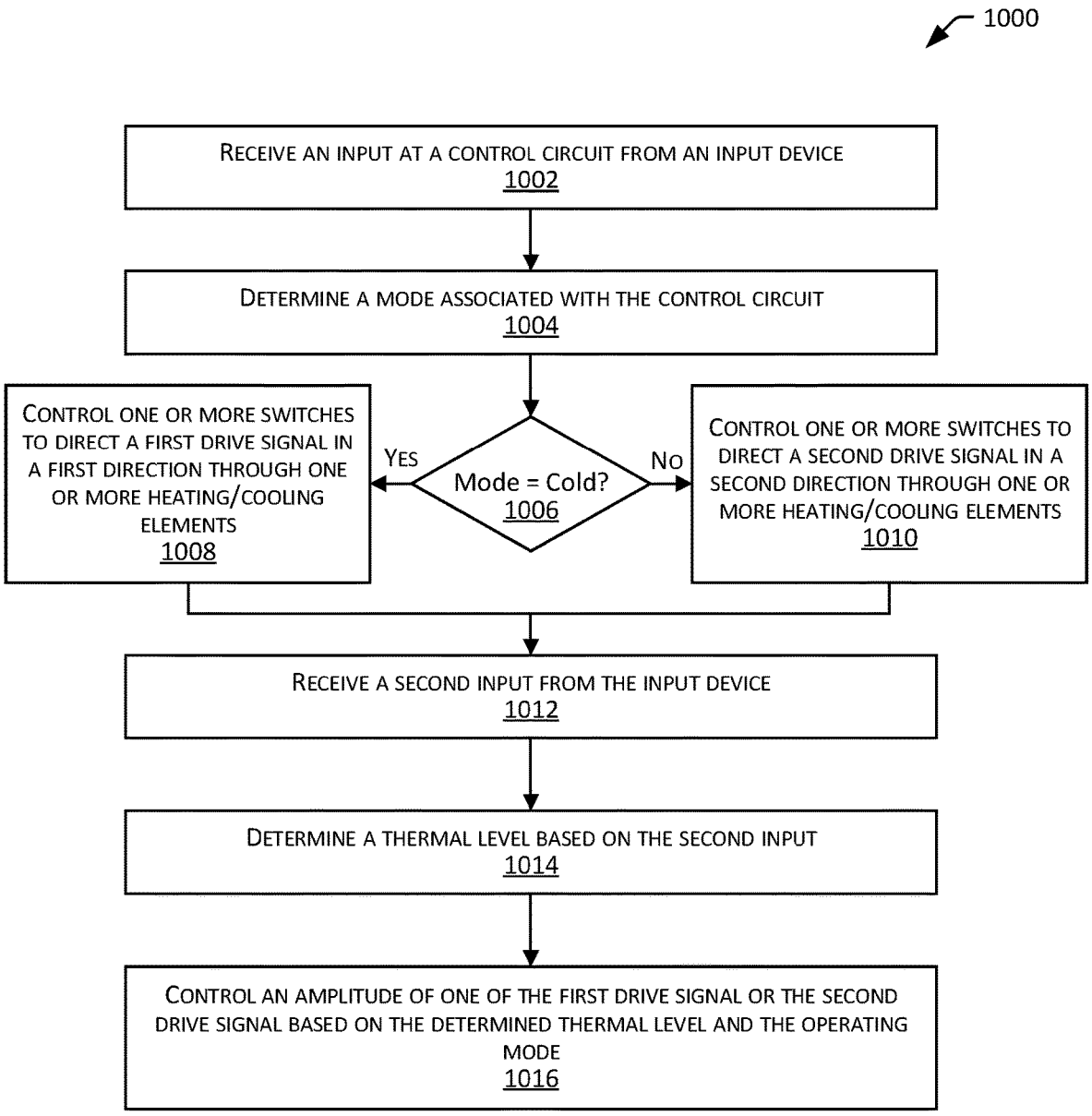
FIG. 10 depicts a flow diagram of a method of providing thermal management using electrical devices, in accordance with certain embodiments of the present disclosure.

FIG. 10 depicts a flow diagram 1000 of a method of providing thermal management using electrical devices, in accordance with certain embodiments of the present disclosure. At 1002, an input may be received at a control circuit from an input device. In some implementations, the input may be received from a button, a switch, or another input feature of a control device coupled to the chair or integrated with the chair. In other implementations, the input may be received from a computing device, through a USB connection or via a wireless transceiver of a control circuit.

At 1004, a mode associated with the control circuit is determined. The mode may be a heating mode or a cooling mode. At 1006, if the mode equals cold (a cooling mode), the circuit may control one or more switches to direct a first drive signal in a first direction through one or more heating/cooling elements, at 1008. The heating/cooling devices may be Peltier devices that have a first side that heats and a second side that cools in response to a first current. The first side may cool and the second side may heat in response to a second current.

At 1006, if the mode is not cold, the circuit may control the one or more switches to direct a second drive in a second direction through one or more heating/cooling elements, at 1010. In an alternative embodiment, if the thermoelectric devices 432 are coupled to separate circuits or loops, the first drive signal is applied to one of the first circuit or the second circuit depending on the operating mode. Other implementations are also possible.

At 1012, a second input may be received from the input device. The second input may include a button press. At 1014, a thermal level is determined based on the second input. In an example, a current state of the circuit may be determined, such as a low state, a medium state, or a high state.

At 1016, the circuit may control an amplitude of one of the first drive signal or the second drive signal based on the determined thermal level. In one example, the circuit may decrease the amplitude. In another example, the circuit may increase the amplitude. In still another example, the circuit may turn off power to the heat exchangers.

In this example, the amplitude of the cooling signal when transitioning from electrical ground to a cold low mode may be larger than the amplitude of the warming signal when transitioning from electrical ground to the hot low mode. Similarly, each transition and the overall signal amplitudes of the signals in the warming modes may be less than the signal amplitudes for the corresponding cooling modes. Other implementations are also possible.

Figure 11:
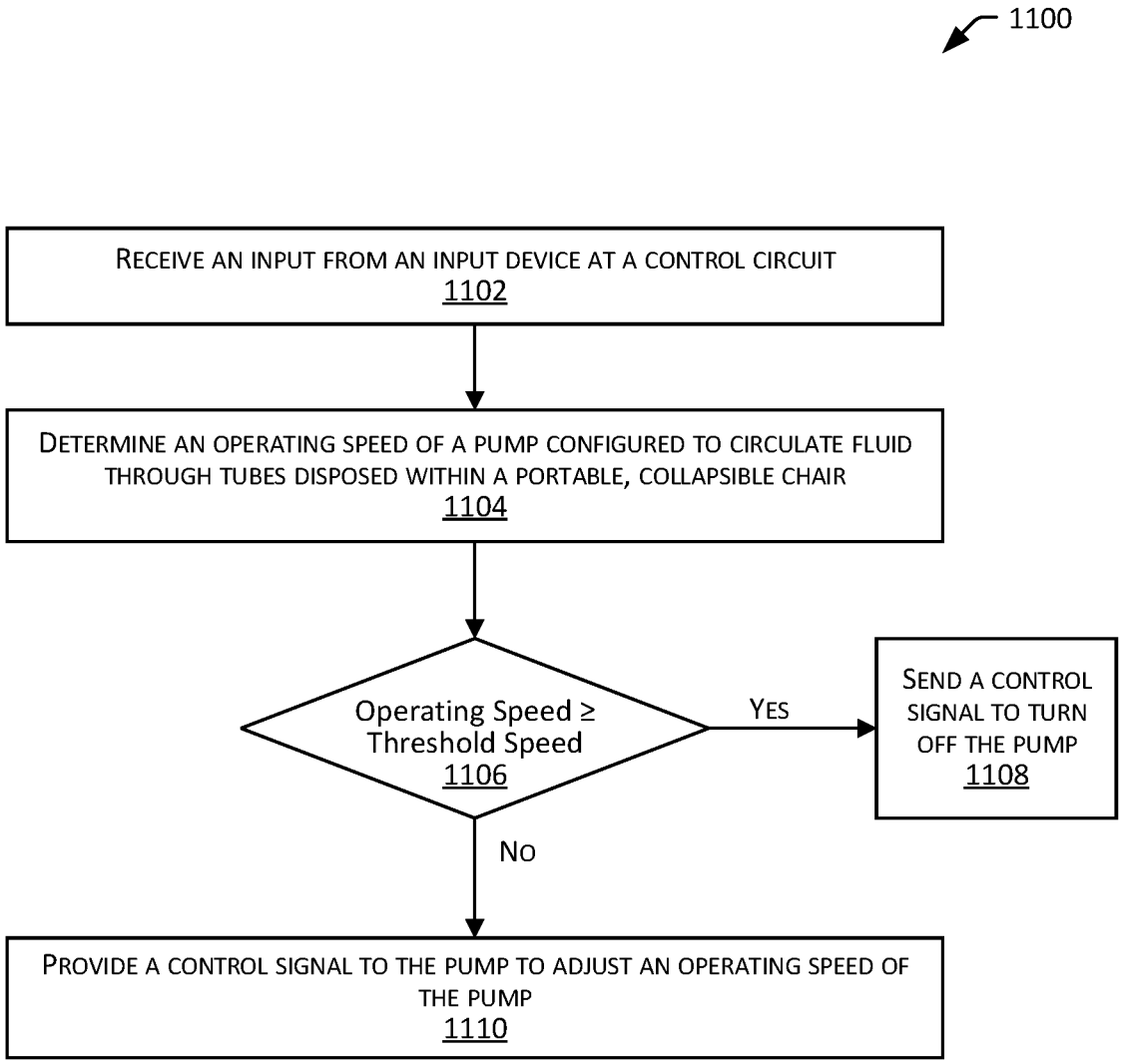
FIG. 11 depicts a flow diagram of a method of providing thermal management using circulating fluid, in accordance with certain embodiments of the present disclosure.

FIG. 11 depicts a flow diagram 1100 of a method of providing thermal management using circulating fluid, in accordance with certain embodiments of the present disclosure. In this example, a cooler or thermos may include a fluid for circulation through the heat exchangers.

At 1102, an input may be received from an input device at a control circuit. In some implementations, the input may be received from a button, a switch, or another input feature of a control device coupled to the chair or integrated with the chair. In other implementations, the input may be received from a computing device, through a USB connection or via a wireless transceiver of a control circuit. In still another implementation, the input may be received from a remote controller device, such as a key fob or other remote.

At 1104, an operating speed of a pump to circulate fluid through tubes disposed within a portable, collapsible chair may be determined. In some implementations, the pump may have a predetermined number of settings or speeds, and the control circuit may determine the speed or setting of the pump. In some implementations, the tubes may form one or more closed loop fluid paths, and fluid may be circulated through each of the one or more closed loop fluid paths. In one possible example, the fluid flow rate may be substantially the same within each of the fluid paths. In another possible example, the fluid flow rate may be varied based on manual inputs received from the control device or based on temperature data determined using one or more sensors. Other implementations are also possible.

At 1106, if the operating speed is greater than or equal to the threshold speed, the control circuit may send a control signal to turn off the pump, at 1108. In an example, a user may press a button on the control device several times to adjust operation of the pump. The first button press may activate the pump to circulate the fluid at a first speed. The second button press may activate the pump to circulate the fluid at a second speed. The third button press may activate the pump to circulate the fluid at a third speed. The fourth button press may cause the control circuit to turn off the pump. In an alternative example, the control circuit may determine a state of the pump and may cycle the state of the pump with each button press through the following states: an off state, a first state, a second state, and a third state. Other implementations are also possible.

Otherwise, at 1110, a control signal may be provided to the pump to adjust an operating speed of the pump. In one possible example, the operating speed may increase with each button press, such as from a first speed to a second speed to a third speed, and so on. In another possible example, the operating speed may decrease with each button press.

Figure 12:
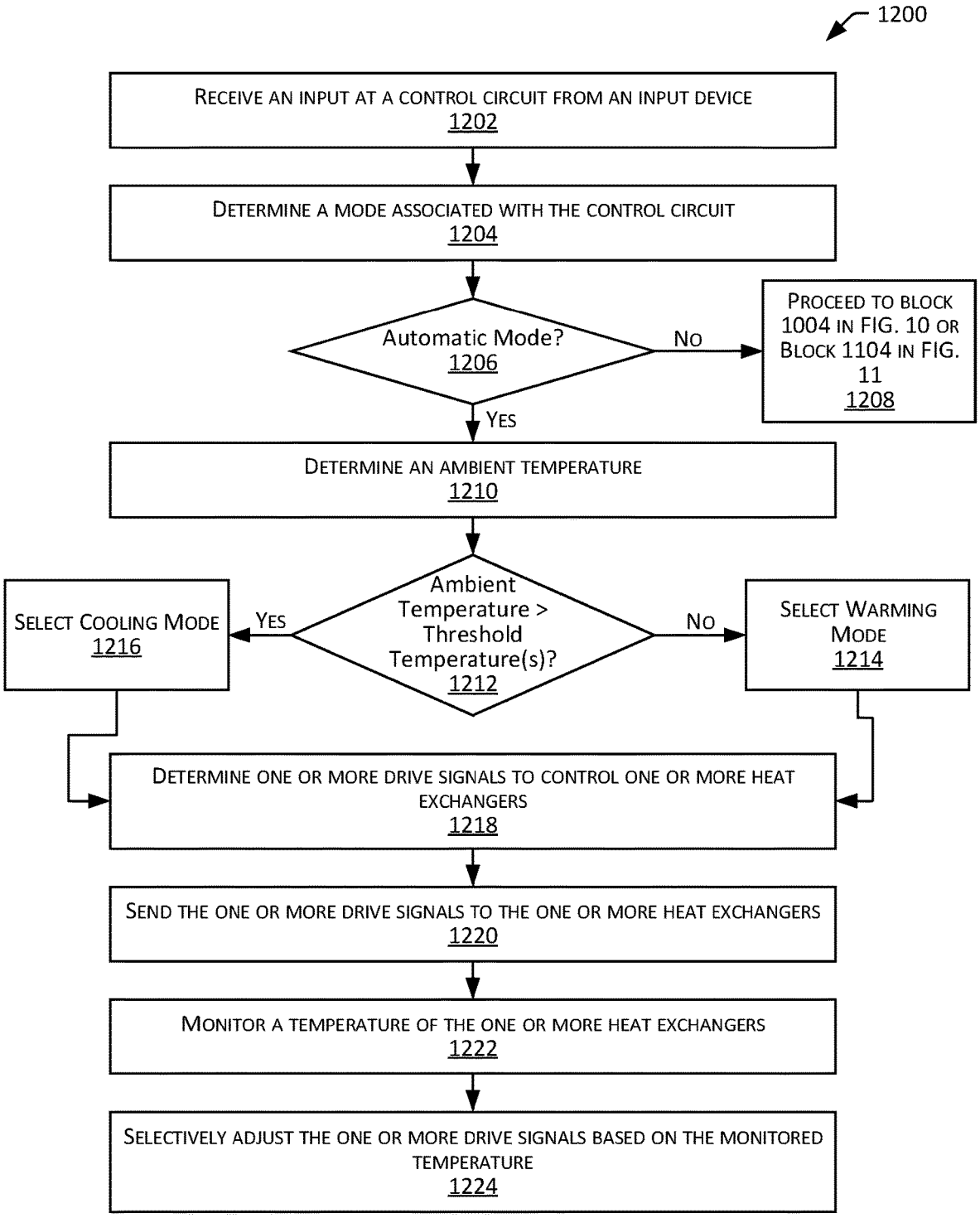
FIG. 12 depicts a flow diagram of a method of automatically providing thermal management, in accordance with certain embodiments of the present disclosure.

FIG. 12 depicts a flow diagram of a method 1200 of automatically providing thermal management, in accordance with certain embodiments of the present disclosure. At 1202, the method 1200 may include receiving an input at a control circuit from an input device. The input device may be a control device, and the input may include signals determined from user interactions with one or more buttons or switches on the control device. In an example, the input may include an "on" signal received by the circuit when the user activates the control device.

At 1204, the method 1200 may include determining a mode associated with the control circuit. At 1206, if the circuit is not in an automatic mode, the method 1200 may include proceeding to block 1004 in FIG. 10 or to block 1104 in FIG. 11, at 1208. Otherwise, at 1206, if the circuit is in the automatic mode, the method 1200 may include determining an ambient temperature 1210. The ambient temperature 1210 may be determined from signals received from one or more sensors.

At 1212, if the ambient temperature is greater than a threshold temperature, the method 1200 may include selecting a cooling mode, at 1216. Otherwise, at 1212, if the ambient temperature is not greater than the threshold temperature, the method 1200 may include selecting a warming mode 1214.

Once the cooling mode or warming mode is selected, the method 1200 may include determining one or more drive signals to control one or more heat exchangers, at 1218. The drive signals may be applied in a first direction through the circuit to implement the cooling mode and in a second direction through the circuit to implement the warming mode. Alternatively, the drive signals may be applied to a first current loop to implement the cooling mode and to a second current loop to implement the warming mode. Other implementations are also possible.

At 1220, the method 1200 may include sending the one or more drive signals to the one or more heat exchangers. Each heat exchanger may be controlled independently and asynchronously with respect to the other heat exchangers. Other implementations are also possible.

At 1222, the method 1200 may include monitoring a temperature of the one or more heat exchangers. A microcontroller unit may monitor the temperature based on signals from one or more temperature sensors.

At 1224, the method 1200 may include selectively adjusting the one or more drive signals based on the monitored temperature. In an example, if the differential temperature produced by one or more of the thermoelectric modules exceeds a threshold difference, the method may include reducing an amplitude of the one or more drive signals to adjust the differential temperature. Other implementations are also possible In conjunction with the systems, devices, and methods described above with respect to FIGS. 1-12, a chair may include a frame including a plurality of frame members being pivotally connected to each other about one or more pivot axes such that at least some of the plurality of frame members are oriented in a crossed manner when chair is in a first configuration and are at least substantially parallel to one another in a collapsed configuration. The chair may further include a backrest formed of fabric or other material coupled to the frame, a seat formed of fabric or other material coupled to the frame, and one or more heat exchangers configured to deliver a selected thermal effect to one or more of the backrest and the seat. Depending on the implementation, the fabric or other material may be fixed to the backrest and the seat or may be removably coupled to the backrest and the seat.

In one aspect, the chair may include first and second armrests coupled to the frame and including a fabric or other material. The one or more heat exchangers may include a first heat exchanger coupled to the first armrest and a second heat exchanger coupled to the second armrest. In one embodiment, the first armrest may include a phone holder including a universal serial bus (USB) port or other port to deliver an electrical charge to a portable computing device. In another possible embodiment, the first armrest, the second armrest, or both may include a cupholder. The cupholder may also include a heat exchanger.

In another aspect, each heat exchanger of the one or more heat exchangers may include one or more thermal elements, such as Peltier devices. In response to a first electrical signal, the one or more thermal elements may draw heat away from the backrest, the seat, or any combination thereof. In response to a second electrical signal, the one or more thermal elements may provide heat to the backrest, the seat, or any combination thereof.

In still another aspect, the chair may include a control device including one or more selectable elements and a circuit coupled to control device and to the one or more heat exchangers. The circuit may provide a control signal to the one or more heat exchangers.

In yet another aspect, the chair may include a pump coupled to a container including a thermal fluid. A tube may be coupled to the pump and may extend from the container to the one or more heat exchangers. The chair may include a control device coupled to the pump and configured to control a flow rate of the thermal fluid through the heat exchangers.

Although the present invention has been described with reference to preferred embodiments, workers skilled in the art will recognize that changes may be made in form and detail without departing from the scope of the invention.

What is claimed is:

1. A chair comprising:

a collapsible frame including a seat portion and a backrest portion;

first and second armrests coupled to the frame, the first armrest includes a phone holder including a universal serial bus (USB) port, one or more of the first armrest and the second armrest includes a cupholder, one or more thermoelectric modules coupled to at least one of the seat portion, the backrest portion, or the first and second armrests; and a control circuit coupled to the one or more thermoelectric modules, in a warming mode, the control circuit to provide at least one first signal to the one or more thermoelectric modules to warm the at least one of the seat portion, the backrest portion, or the first and second armrests and in a cooling mode, the control circuit to provide at least one second signal to the one or more thermoelectric modules to cool the at least one of the seat portion, the backrest portion or the first and second armrests.

2. The chair of claim 1, wherein:

in the warming mode, the at least one first signal comprises a first signal having a first amplitude; and in the cooling mode, the at least one second signal comprises a second signal having a second amplitude;

the second amplitude is greater than the first amplitude.

3. The chair of claim 1, wherein the collapsible frame forms a bleacher set configured to rest on one of a bleacher, a bench, or a chair.

4. The chair of claim 1, wherein, in the warming mode, the at least one first signal comprises:

a first signal having a first amplitude to provide a first temperature difference relative to an ambient temperature; and one or more second signals having one or more second amplitudes to provide one or more second temperature differences relative to the ambient temperature.

5. The chair of claim 1, wherein, in the cooling mode, the at least one second signal comprises:

a first signal having a first amplitude to provide a first temperature difference relative to an ambient temperature; and one or more second signals having one or more second amplitudes to provide one or more second temperature differences relative to the ambient temperature.

6. The chair of claim 1, further comprising:

a temperature sensor to provide a sensor signal related to an ambient temperature to the control circuit; and wherein the control circuit compares the ambient temperature to a threshold temperature and automatically selects one of:

the warming mode when the ambient temperature is less than or equal to the threshold temperature; or the cooling mode when the ambient temperature is greater than the threshold temperature.

7. The chair of claim 1, further comprising a control device communicatively coupled to the control circuit, the control device including one or more control options accessible by a user to select between the warming mode or the cooling mode.

8. The chair of claim 1, wherein the control circuit generates the at least one first signal or the at least one second signal having a time-varying waveform.

9. The chair of claim 1, wherein the one or more thermoelectric modules comprises a plurality of thermoelectric modules including:

a first set of thermoelectric modules coupled electrically in series to form a first circuit; and a second set of thermoelectric modules coupled electrically in series to form a second circuit.

10. The chair of claim 9, further comprising:

a first conductor coupled to the first set of thermoelectric modules;

a second conductor coupled to the second set of thermoelectric modules: and wherein the control circuit applies the at least one first signal to the first conductor to cause the first set of thermoelectric modules to warm the at least one of the seat portion or the backrest portion and applies the at least one second signal to the second conductor to cause the first set of thermoelectric modules to cool the at least one of the seat portion or the backrest portion.

11. The chair of claim 9, further comprising:

a first input coupled to the first set of thermoelectric modules;

a second input coupled to the second set of thermoelectric modules; and an output coupled to the first set and the second set of thermoelectric modules; and wherein:

in a first mode, the control circuit applies the at least one first signal to the first input to cause the first set of thermoelectric modules to warm; and in a second mode, the control circuit applies the at least one second signal to the second input to cause the second set of thermoelectric modules to cool.

12. A chair comprising:

a frame including one or more pivot elements to facilitate collapsing of the frame to enable a user to carry the frame in a first state and to facilitate expansion of the frame to form a chair in a second state;

a backrest coupled to the frame;

a seat coupled to the frame;

one or more heat exchangers coupled to one or more of the backrest and the seat; and a control circuit coupled to the one or more heat exchangers and configured to provide a one or more first signals to the one or more heat exchangers to produce a warming effect in a warming mode and to provide one or more second signals to the one or more heat exchangers to produce a cooling effect in a cooling mode; and a temperature sensor to provide a sensor signal related to an ambient temperature to the control circuit; and wherein the control circuit compares the ambient temperature to a threshold temperature and automatically selects one of:

the warming mode when the ambient temperature is less than or equal to the threshold temperature; or the cooling mode when the ambient temperature is greater than the threshold temperature.

13. The chair of claim 12, further comprising:

first and second armrests coupled to the frame, one or more of the first armrest or the second armrest includes a cupholder; and wherein the one or more heat exchangers includes a first heat exchanger coupled to the first armrest and a second heat exchanger coupled to the second armrest.

14. The chair of claim 12, wherein:

in the warming mode, the one or more first signals comprises a first signal having a first amplitude; and in the cooling mode, the one or more second signals comprises a second signal having a second amplitude;

the second amplitude is greater than the first amplitude.

15. The chair of claim 12, wherein:

in the warming mode, the one or more first signals comprise:

a first signal having a first amplitude to provide a first temperature difference relative to an ambient temperature; and at least one second signal having one or more second amplitudes to provide one or more second temperature differences relative to the ambient temperature; and in the cooling mode, the one or more second signals comprise:

a first signal having a first amplitude to provide a first temperature difference relative to the ambient temperature; and one or more second signals having one or more second amplitudes to provide one or more second temperature differences relative to the ambient temperature.

16. The chair of claim 12, further comprising a control device communicatively coupled to the control circuit, the control device including one or more control options accessible by a user to select between the warming mode or the cooling mode.

17. A chair comprising:

a collapsible frame including a seat portion and a backrest portion;

a first armrest and a second armrest coupled to the frame;

one or more heat exchangers coupled to one or more of the backrest, the seat, the first armrest, or the second armrest; and a control circuit coupled to the one or more heat exchangers, in a warming mode, the control circuit to provide at least one first signal to the one or more thermoelectric modules to provide a warming effect and, in a cooling mode, to provide at least one second signal to the one or more thermoelectric modules to provide a cooling effect, wherein:

in the warming mode, the at least one first signal comprises:

a first signal having a first amplitude to provide a first temperature difference relative to an ambient temperature; and at least one second signal having one or more second amplitudes to provide one or more second temperature differences relative to the ambient temperature; and in the cooling mode, the at least one second signal comprises:

a third signal having a third amplitude to provide a third temperature difference relative to the ambient temperature; and one or more fourth signals having one or more fourth amplitudes to provide one or more fourth temperature differences relative to the ambient temperature; and wherein the control circuit generates one or more of the at least one first signal or the at least one second signal having a time-varying waveform.

18. The chair of claim 17, wherein the first armrest includes one or more of a cupholder or a smartphone holder.

19. The chair of claim 18, wherein one or more heat exchangers includes a heat exchanger coupled to one of the cupholder or the smartphone holder.

20. The chair of claim 17, further comprising:

a rechargeable battery configured to supply power to one or more of the control circuit or the one or more heat exchangers; and wherein the smartphone holder includes a universal serial bus (USB) port coupled to the rechargeable battery.

* * * * *